US011259625B2

(12) United States Patent
Myers

(10) Patent No.: US 11,259,625 B2
(45) Date of Patent: Mar. 1, 2022

(54) ENHANCED HAIR PRODUCT APPLICATION WITH CONCURRENT STYLING

(71) Applicant: Dawn N. Myers, Washington, DC (US)

(72) Inventor: Dawn N. Myers, Washington, DC (US)

( * ) Notice: Subject to any disclaimer, the term of this patent is extended or adjusted under 35 U.S.C. 154(b) by 0 days.

(21) Appl. No.: 16/358,816

(22) Filed: Mar. 20, 2019

(65) Prior Publication Data

US 2020/0093249 A1 Mar. 26, 2020

Related U.S. Application Data

(63) Continuation of application No. 16/278,091, filed on Feb. 16, 2019.

(Continued)

(51) Int. Cl.
*A46B 11/00* (2006.01)
*A46B 11/08* (2006.01)

(Continued)

(52) U.S. Cl.
CPC ..... *A46B 11/0055* (2013.01); *A45D 1/04* (2013.01); *A45D 6/00* (2013.01); *A45D 24/10* (2013.01);

(Continued)

(58) Field of Classification Search
CPC ... A45D 1/04; A45D 1/06; A45D 1/10; A45D 1/14; A45D 2/001; A46B 11/0065; A46B 2200/104

(Continued)

(56) References Cited

U.S. PATENT DOCUMENTS 1,449,096 A 3/1923 Grieten
1,615,581 A * 1/1927 Harris ..... A45D 24/24 222/88

(Continued)

FOREIGN PATENT DOCUMENTS

FR 3028394 B1 5/2016
WO 2013/171732 A1 11/2013

(Continued)

OTHER PUBLICATIONS

Amazon Product Listing, "Huachi Steam Hair Straightener Flat Iron Ceramic Tourmaline Plates, Salon Hair Iron Dual Voltage Travel 2 in 1 Straightening Iron with Adjustable Temperature, 1- inch, Black by Huachi", www.amazon.com/Huachi-Straightener-Tourmaline-Straightening-Temperature/dp/B06XQ2RLP7?th=1.

(Continued)

*Primary Examiner* — Rachel R Steitz
*Assistant Examiner* — Brianne E Kalach
(74) *Attorney, Agent, or Firm* — Robert L Protheroe

(57) ABSTRACT

Embodiments of hair care apparatus and methods are provided generally comprising a location to provision hair care product, an applicator and a manipulator configured to enable concurrent product application and hair manipulation, and may comprise a product heater, configured to heat product provisioned therein, or be configured for use with an external heating source such as a microwave oven, and provide application of heated product at temperatures both safe for hair health and enhanced absorption. Apparatus may comprise a source of pressure, such as a pump or piston, to generate hair product flow through an applicator, and may be configured to receive product in user fillable or prepackaged product cartridges usable in the apparatus, a product chamber within the apparatus or a removable product reservoir useable in the apparatus. An apparatus may further be (Continued)

configured to support a plurality of manipulators, active applicators and passive applicators.

21 Claims, 20 Drawing Sheets

Related U.S. Application Data

(60) Provisional application No. 62/734,530, filed on Sep. 21, 2018.

(51) Int. Cl.
*A45D 24/10* (2006.01)
*A45D 1/04* (2006.01)
*A45D 6/00* (2006.01)
*A46B 9/02* (2006.01)

(52) U.S. Cl.
CPC ..... *A46B 9/023* (2013.01); *A46B 11/0013* (2013.01); *A46B 11/0062* (2013.01); *A46B 11/08* (2013.01); *A46B 2200/104* (2013.01)

(58) Field of Classification Search
USPC ..... 132/116, 269, 271
See application file for complete search history.

(56) References Cited

U.S. PATENT DOCUMENTS 2,228,213 A 1/1941 Hillsberry
2,254,266 A 9/1941 Cannon
2,299,296 A 10/1942 Battle
2,601,858 A * 7/1952 Ackerman ..... A45D 24/24 132/116
2,705,499 A 4/1955 Breeze
2,737,190 A * 3/1956 Magnusson ..... A45D 24/24 132/114
2,827,060 A 3/1958 Marty
2,865,383 A 12/1958 Kaley
2,880,299 A 3/1959 Jones
3,295,537 A 1/1967 Young
3,491,777 A 1/1970 Grosbard
3,520,311 A 7/1970 Iesersek et al.
3,610,259 A 10/1971 Brown
3,835,292 A 9/1974 Walter et al.
3,934,114 A 1/1976 Godel et al.
4,032,747 A 6/1977 Kunz
4,121,602 A * 10/1978 Young ..... A45D 24/22 132/113
4,294,270 A 10/1981 Cochran
4,319,852 A 3/1982 Bell et al.
4,674,902 A 6/1987 Turner
4,875,792 A * 10/1989 Canada ..... A46B 11/001 401/283
4,913,172 A * 4/1990 Chou ..... A01K 13/002 119/603
5,337,764 A 8/1994 McKay
5,622,192 A 4/1997 Chiou
5,913,315 A * 6/1999 Todd ..... A45D 2/40 132/206
5,927,290 A * 7/1999 Thiruppathi ..... A46B 11/0017 132/116
6,047,862 A 4/2000 Davies
6,070,596 A * 6/2000 Altamore ..... A45D 1/04 132/224
6,119,702 A * 9/2000 Habibi ..... A45D 1/04 132/118
D474,343 S * 5/2003 Cammarano ..... D4/120
6,955,176 B2 * 10/2005 Ackermans ..... A45D 19/02 132/112
7,033,581 B2 * 4/2006 Pyles ..... A45D 19/18 424/70.1
7,427,169 B2 9/2008 Ma et al.
7,695,207 B1 4/2010 Laghi
8,136,263 B2 3/2012 Schmid
8,220,100 B2 * 7/2012 Diamond ..... A46B 5/0012 132/132
8,561,620 B2 10/2013 Morgandi et al.
D836,837 S * 12/2018 Yan ..... D28/35
10,271,627 B1 * 4/2019 Calvo ..... A45D 19/02
2002/0190047 A1 * 12/2002 Nam ..... A45D 1/04 219/222
2005/0016557 A1 * 1/2005 Fasan ..... A46B 5/0012 132/132
2005/0076930 A1 * 4/2005 Yuen ..... A46B 15/0024 132/132
2005/0133055 A1 * 6/2005 Stankovic ..... A46B 11/0062 132/116
2006/0108344 A1 * 5/2006 Kim ..... A45D 1/04 219/225
2006/0144414 A1 * 7/2006 Carballada ..... A45D 1/04 132/224
2007/0144549 A1 * 6/2007 Enriquez ..... A45D 24/28 132/116
2008/0149124 A1 * 6/2008 McKay ..... A61P 37/00 132/116
2009/0320867 A1 12/2009 Lee
2011/0067717 A1 * 3/2011 McHugh ..... A01K 13/002 132/114
2011/0226278 A1 * 9/2011 Rivola ..... A45D 1/06 132/232
2012/0272993 A1 * 11/2012 Fereyre ..... A45D 6/00 132/221
2013/0048003 A1 * 2/2013 Antons ..... A45D 24/28 132/116
2013/0192625 A1 * 8/2013 Migliori ..... A45D 7/06 132/211
2015/0289622 A1 * 10/2015 Fereyre ..... A45D 2/001 132/211
2016/0324290 A1 * 11/2016 Fereyre ..... A45D 1/04
2017/0013932 A1 1/2017 Nichols
2017/0079400 A1 3/2017 Fereyre
2019/0350346 A1 * 11/2019 Samain ..... A45D 19/00

FOREIGN PATENT DOCUMENTS

WO 2015/097625 A2 7/2015
WO WO 2017/108975 * 6/2017

OTHER PUBLICATIONS

International Search Report and Written Opinion, PCT Application No. PCT/US19/52309, dated Dec. 17, 2019, 16 pages.

* cited by examiner

ENHANCED HAIR PRODUCT APPLICATION WITH CONCURRENT STYLING

CROSS-REFERENCE TO RELATED APPLICATIONS

This application is a continuation of, and claims the benefit of, copending U.S. patent application Ser. No. 16/278,091, filed Feb. 16, 2019, which claims the benefit of U.S. Provisional Application No. 62/734,530, filed Sep. 21, 2018. This application additionally claims the benefit of U.S. Provisional Application No. 62/734,530, filed Sep. 21, 2018.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

BACKGROUND

The subject matter of this disclosure generally relates to apparatus and methods for hair care, and more specifically relates to apparatus and methods for enhanced hair product application with concurrent styling.

There has been a growing trend among women of African descent to wear their hair in its natural state (hereinafter referred to as "natural hair") choosing to eliminate the use of treatment and styling methods such as relaxing curls and straightening. Women within this growing consumer segment are choosing to preserve and enhance the natural curls present in natural hair. Natural hair requires care routines specifically designed to address the unique characteristics of natural hair. Morphological differences in natural hair comprising texture, shape, strength, elasticity, and thickness complicate the cleansing and styling process and effect the natural hair's ability to retain moisture and maintain health. Furthermore, natural hair is particularly sensitive to treatment and styling processes involving elevated heat. Because natural hair tends to be stiffer, drier, and highly susceptible to breakage, many consumers in this segment expend considerable effort and expense to apply products to care for their hair in ways comprising nourishing their hair, conditioning their hair, repairing damage present in their hair, moisturizing their hair and sealing moisture within their hair. Styling natural hair requires further considerable effort to detangle, enhance and care for ubiquitous amounts of curls.

The process for applying hair products to and styling natural hair is painstaking, messy and lengthy involving multiple separate steps comprising detangling a section of the hair using combs and/or brushes and applying hair product into the sectioned hair. This process is repeated section by section and further comprises manipulating the hair to achieve the desired style. The person applying product and manipulating the hair has to frequently pickup and put down hair product and pick up and put down combs and/or brushes. Furthermore, it is difficult to control the application of hair products, particularly low viscosity hair products, resulting in hair product being wasted through runoff and dripping, and requiring cleanup during and after hair product application.

Absorption of hair product into the hair is expedited and enhanced by the introduction of heat. As a result, methods for caring for natural hair ideally include heated hair product, such as heated oil treatments, which require preheating, thereby reducing the viscosity, and applying the heated product using the current process discussed above, thus making heated product treatments particularly time consuming, unwieldy and prone to mess and waste. Furthermore, maintaining a temperature level which is safe for natural hair yet high enough to result in effective and enhanced absorption throughout a lengthy hair care process is extremely difficult and commonly not achieved. Lastly, moisture in hair has a plasticizing effect which is beneficial in natural hair through the softening of an aforementioned brittle characteristic common therein, and through the provision of elasticity which, in moderation, reduces stress and breakage during manipulation. However under increased levels of a plasticized condition, natural hair begins to lose internal structuring which supports and maintains curls, and furthermore, natural hair will eventually become too elastic and too easily stretched, and thereby prone to stress and damage during manipulation. In the presence of excess moisture, such as that provided by hair products and potentially also provided by recent cleaning of the hair, the rate of plasticization is increased with temperature and the degree of plasticization increases over time. For hair types other than natural hair, where a goal of a hair care procedure may be to add curls to otherwise characteristically straight or wavy hair, the process may be best achieved by first reaching a sufficient degree of plasticization to weaken hair structure , organizing the hair in its desired curl and shape, and then removing moisture, typically assisted with a high level of heat, to remove the plasticized state, thereby returning a supporting structure, or, in terms commonly used in hair care, "set the hair". As such, many of the procedures which are promoted and used to provide for curls, are in fact detrimental to curls when caring for natural hair. For natural hair, there is a significant departure needed from the hair care procedures used in other hair types. Natural hair should ideally be nourished, moisturized, and plasticized to a first level that overcomes a characteristic brittleness, all through product absorption at temperatures and durations that do not cause plasticization of a second level that results in excessive weakening of hair structure, and furthermore, through product absorption at temperatures and durations that do not cause heat related stress.

Caring for natural hair outside of the home is problematic and requires a supply of hair product and styling equipment such as combs and/or brushes be present and the process described above to be performed away from home. This results in many women avoiding exercising, swimming and other desirable activities in order to avoid carrying cumbersome hair care equipment and products, followed by washing and a painstaking, messy and lengthy hair care process in a remote location.

While the above discussion is directed towards natural hair, care of other hair types are associated with the challenges described above.

BRIEF SUMMARY OF THE INVENTION

According to some possible and illustrative embodiments of the disclosed subject matter, an apparatus and method may provide for a hair care process comprising an application of hair product, hereinafter referred to as "product", and manipulation of hair. The apparatus may receive a provision of product, of which product may flow through at least one opening to an exposed surface, hereinafter referred to as an "applicator", and may be available for contact with and transfer to hair during a hair care process. The apparatus may also be equipped with manipulation features, hereinafter referred to as a "manipulator". A manipulator may comprise one or more manipulation features, such as teeth, bristles and/or other structures to manipulate hair for detangling, curl enhancing, combing, brushing, shaping, styling and other forms of manipulation during a hair care process. An applicator may be configured to comprise a manipulator. Product may flow to or through an applicator, including a manipulator comprised thereby, and may be available for contact with and transfer to hair concurrently with hair manipulation during a hair care process. An applicator may be configured in an opposing orientation to a manipulator or other surface and capture hair there between, wherein product may flow to or through an applicator and may be available for contact with and transfer to hair concurrently with hair manipulation during a hair care process. One of more applicators may be configured and may be operably coupled to more than one provision of product, wherein more than one type of product may be applied concurrently, and wherein application may be concurrent with hair manipulation during a hair care process.

A surface of an applicator, manipulator and/or other surface of the apparatus which contacts the hair may comprise one or more product retention features such as a plurality of small well-like structures, ridges, troughs and/or raised perimeters which serve to retain excess product which may be subsequently transferred to hair.

An apparatus may be configured comprising a handle, at least one manipulator and at least one applicator, wherein at least one of the at least one applicators may comprise one of the at least one manipulators. An apparatus may comprise opposing arms which may be pivotally attached on one end, and which may form an opening and closing clamp feature on the other end, wherein the clamp feature may comprise at least one applicator and at least one manipulator, at least one of the at least one applicators may comprise one of the at least one manipulators, and hair may be captured between the clamp feature when the opposing arms are pivotally drawn towards each other. The at least one applicator and at least one manipulator or combinations thereof may be further configured to close hair product flow openings to prevent product flow when the opposing arms are pivotally drawn together to close the clamp, such as when the apparatus is not in use. The term clamp as it is used in this disclosure and in relation to the aforementioned configuration of moveably joined opposing arms refers to a general structure and does not imply a clamping force is required or intended. In operation, when hair is captured in the clamp, it is generally loosely constrained such that the manipulator may be passed through the hair, and thus a clamping force is not present and is not desirable.

An apparatus may comprise a product heater, such as a heating element configured to heat product provisioned therein. Alternatively, a product cartridge usable in an apparatus, an apparatus comprising a product chamber, or a removable product reservoir useable in an apparatus, may be constructed such that it may house product which may be heated in a microwave oven or heated liquid bath while housed therein. Whether heating product using a heating source internal or external to the apparatus, absorption of product into hair may be enhanced through a direct heating of product and indirect heating of hair thereby. A product heater may be operable in conjunction with a heat sensor, such as a thermistor, and circuity to maintain temperature, such as a single predetermined temperature, a plurality of selectable or readable predetermined temperatures, or a variable temperature settable from a predetermined range, which may be predetermined temperatures or predetermined ranges of temperatures determined to both be safe for hair health and enhance product absorption. Circuitry may additionally provide a user indication that an appropriate product temperature is present for application of product. An example of a user indication would be a specific color emitted from an LED. A product heater may be configured to heat product in a product cartridge, reservoir or other vessel. A product heater may be configured to heat product as it flows from a product cartridge, reservoir or other vessel and out of an applicator, such as in an on-demand heating embodiment. A thermochromatic material may be used in the manufacture a product cartridge, reservoir, or other vessel, or a portion thereof, or a thermochromatic label may be attached to a product cartridge, product reservoir, or other product vessel, such that after heating product contained therein, such as heating in a microwave oven or heated liquid bath, the thermochromatic material or label may emit a specific color or colors, or reveal lettering and/or one or more graphics to indicate an appropriate temperature or range of temperature is present for application of product. Such an appropriate temperature or range of temperature may be that which is determined to both be safe for hair health and enhance product absorption. Throughout this disclosure, the term product vessel may be used to refer to a container which may receive or otherwise comprise a volume of product such as a product reservoir, a product chamber and product cartridge. Various embodiments of apparatus that may receive a volume of product are possible including an apparatus comprising a product reservoir which may be a removable product reservoir, an apparatus comprising a product chamber which may be comprised, at least in part, by a housing of the apparatus, and an apparatus which may receive a product cartridge, such as by an insertion of the product cartridge into a cartridge chamber of the apparatus. A product cartridge can be a product vessel comprising a product reservoir, or a product vessel comprising a product reservoir and a rigid dispensing end, and as such, illustrates that a product vessel may comprise a product vessel. A product cartridge can be comprised by a cartridge shell assembly wherein a product cartridge is received by a cartridge shell and one of the product cartridge and the cartridge shell may comprise a rigid dispensing end. Additionally, a product cartridge can be a product vessel comprising a product reservoir, a rigid dispensing end and an outer shell. As such, a product cartridge shell assembly can also be referred to as a product cartridge. Additionally, product cartridges may be referred to as both being product vessels and as comprising product vessels.

An apparatus may use gravitational forces and/or acceleration forces generated through movement of the apparatus to move product through an applicator for contact with and transfer to hair. An apparatus may use a source of pressure, such as a pump, piston, pre-pressurized mechanism or other mechanism to generate pressure to create flow of hair product through an applicator. A pump or piston may be manually driven or electrically driven.

An apparatus may use a user fillable product cartridge. An apparatus may use a prepackaged product cartridge. An apparatus may be configured indicate a remaining product capacity, such as a remaining capacity of product in a product cartridge. A product cartridge may comprise a thermochromatic material or label, such that after heating product contained therein, such as heating in a microwave oven or heated liquid bath, the thermochromatic material or label may indicate product is at an appropriate temperature level or range of temperature for application. An apparatus may comprise a product heater and use a product cartridge. A product cartridge may comprise a readable target temperature feature on the product cartridge, and an apparatus may be configured to read the target temperature and heat product to the target temperature as determined by such reading. A product supplier may supply prepackaged product cartridges comprising product and a readable target temperature, wherein the target temperature may be a preferred or optimal temperature for product application and specified by the product supplier. An apparatus may use a product cartridge and heat product thereof to a fixed, selectable or readable target temperature wherein the target temperature is a single and fixed predetermined temperature, a plurality of selectable or readable predetermined temperatures, or a variable temperature settable or readable and within a predetermined range, all of which may be predetermined temperatures or predetermined ranges of temperatures determined to both be safe for hair health and enhance product absorption. Circuitry may additionally provide a user indication that product of an appropriate product temperature may be applied. An example of a user indication would be a specific color emitted from an LED. An apparatus may be configured to use a product cartridge and dispense product therefrom by applying a positive pressure to the cartridge, such as pressure generated by application of force from a piston. An apparatus may use a product cartridge and extract product therefrom by applying a negative pressure (vacuum pressure), such as a negative pressure generated by a pump head of a pump follower system.

An apparatus may be configured for battery powered operation when electrical power may be required, such as needed to power a product heater, LED indicators, an electric pump, or other electrically powered components and circuitry. Battery power may be from a replaceable non-rechargeable battery source or from a removable or non-removable rechargeable battery source. An apparatus configured to use a non-removable rechargeable battery source may be configured for recharging using an external wall power adapter or a USB port. An apparatus configured to use a removable rechargeable battery source may be configured for recharging using an external wall power adapter or a USB port, and/or an external battery charger.

In the foregoing summary disclosure, a plurality of illustrative embodiments have been described. Each embodiment generally comprises an applicator, a manipulator and a can receive a provision of product and is configured to enable a user to concurrently apply product and style or otherwise manipulate their hair. Some embodiments comprise product delivery systems which may use pressure to generate product flow, and some embodiments comprise product delivery systems which may utilize gravitational forces to deliver product flow. Illustrative embodiments of pressure based product delivery systems are disclosed herein which may comprise mechanical pumps, both air and airless, electrical pumps and spring driven pistons. Some illustrative embodiments disclosed herein may comprise an internal heating system and some illustrative embodiments support a heating of product in a microwave oven or in a heated liquid bath, or other form of external heating of product. Illustrative embodiments disclosed may receive a provision of product in a variety of ways comprising in a housing, in a reservoir and in a cartridge, the latter of which may be a user filled cartridge, or may be a prepackaged cartridge. A detailed disclosure of various illustrative embodiments which may relate to one or more aspects of the foregoing summary disclosure is provided following a brief description of the several views of the drawings.

BRIEF DESCRIPTION OF THE SEVERAL VIEWS OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of the disclosed subject matter.

DETAILED DESCRIPTION OF THE INVENTION

Figure 1A:
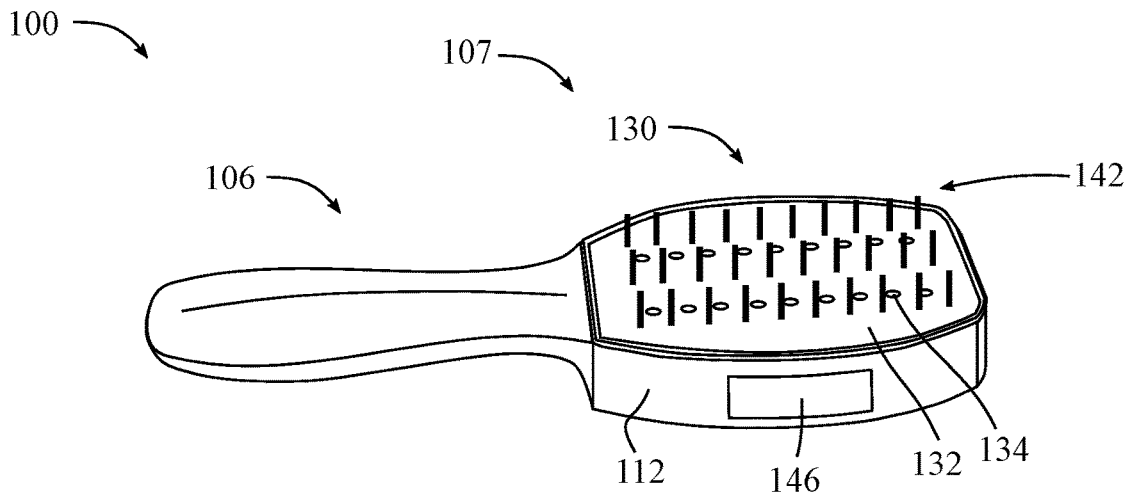
FIG. 1*a* is a perspective view of an illustrative embodiment with a handle.

Detailed illustrative embodiments of the present invention are disclosed herein; however, it is to be understood that the disclosed embodiments are merely illustrative of the invention that may be embodied in various forms. In addition, each of the examples given in connection with the various embodiments of the invention is intended to be illustrative, and not restrictive.

The following detailed illustrative embodiments refer to the accompanying drawings. The same reference number may appear in multiple drawings and when appearing in multiple drawings will identify the same or similar elements. For brevity, a reference number and its referenced element will be disclosed in accompanying text herein and in relation to a first appearance in the drawings, but may not be explicitly referred to in accompanying text again when appearing in subsequent drawings.

Embodiments of a hair care apparatus and method are disclosed. Each embodiment may provide a location to provision product, an applicator and a manipulator which are configured to enable both an application of product and a manipulation of hair. Hair can therefore receive the application of product in a concurrent operation, or in adjacent operations, of hair manipulation using the disclosed apparatus. Hair manipulation can include detangling, curl enhancing, combing, brushing, shaping, styling and other forms of manipulation.

Figure 1B:
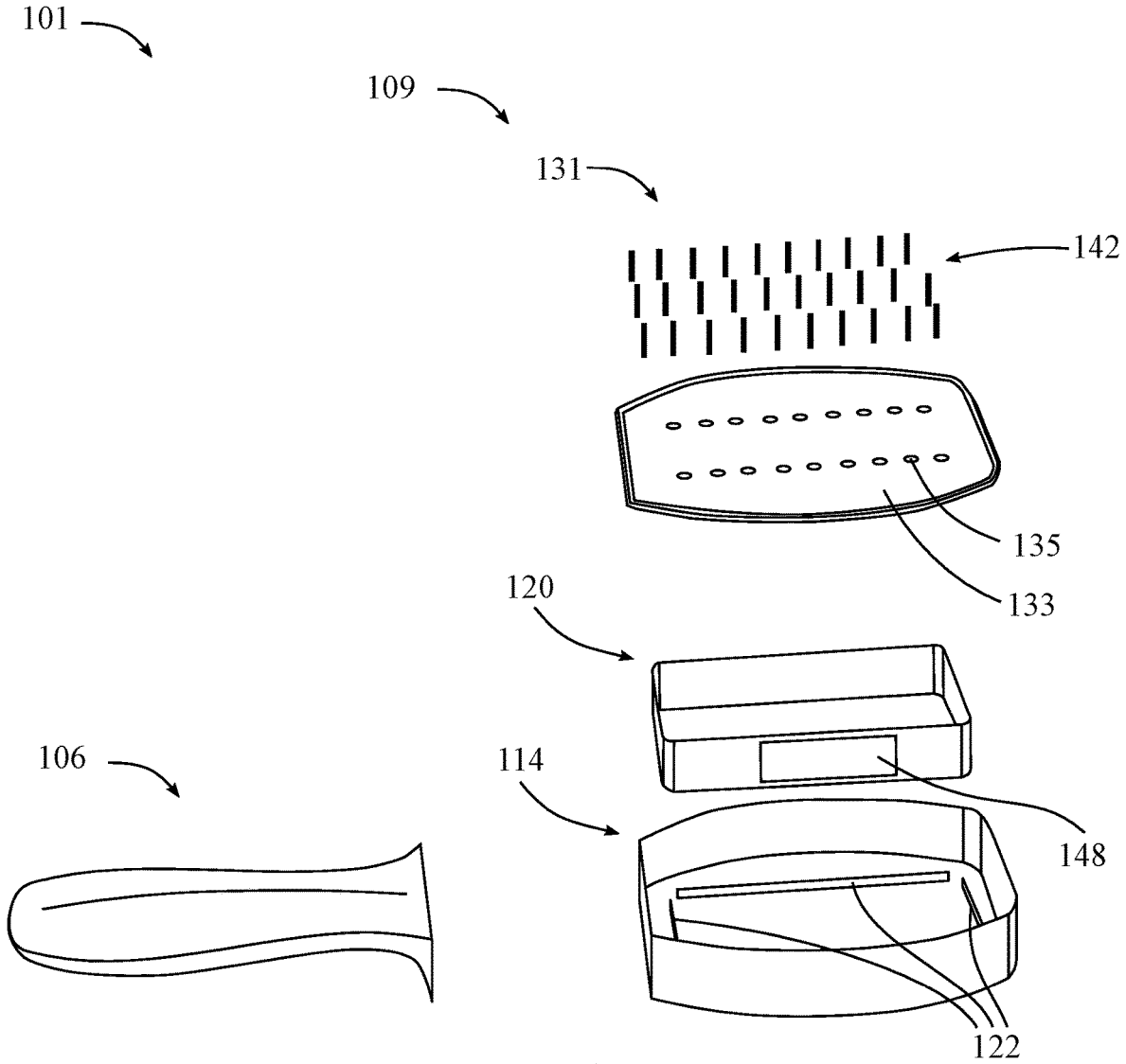
FIG. 1*b* is an exploded view of an illustrative embodiment with a handle.

FIG. 1*a* and FIG. 1*b* depict illustrative embodiments of hair care apparatus 100 and 101, respectively. FIG. 1*a* is a perspective view of apparatus 100. FIG. 1*b* is an exploded view of apparatus 101 and serves to aid in an understanding of both embodiments of apparatus 100 and 101 due to similar and common features comprised therein. Similar and common features comprise a handle 106, heads 107 and 109, applicators 130 and 131, each of which comprises a manipulator 142. The embodiment of FIG. 1*b* comprises a removable product reservoir 120, which may also be referred to as a removable product vessel. Alternatively, the housing 112 of the embodiment of FIG. 1*a* serves as a product vessel or product reservoir.

Figure 1C:
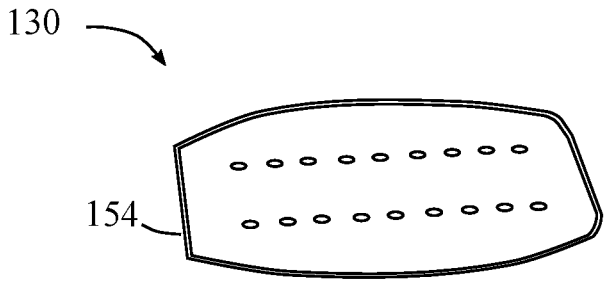
FIG. 1*c* is a bottom view of an applicator of the embodiment of FIG. 1*a* comprising a seal.
Figure 1D:
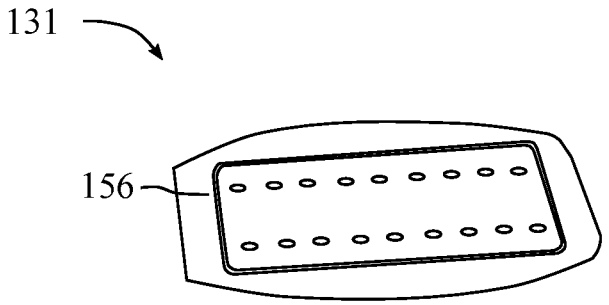
FIG. 1*d* is a bottom view of an applicator of the embodiment of FIG. 1*b* comprising a seal.

Applicators 130 and 131 are removably attached to housings 112 (FIG. 1*a*) and 114 (FIG. 1*b*), respectively, and when removed provide access to housing 112 or reservoir 120, respectively, to dispose product therein. Product can include oils and other liquids produced commercially for hair care, or oils and liquids which may alternatively be used as a hair care product, for example, coconut oil, or may be produced from homemade recipes. Additional forms of product will be disclosed later herein. Applicators 130 and 131 comprise exposed applicator surfaces 132 and 133, respectively, comprising a plurality of holes 134 and 135, respectively, and when attached to housing 112 or 114, respectively, the holes permit product to flow from housing 112 or reservoir 120 to the exposed applicator surfaces 132 and 134 of applicators 130 and 131, respectively. Briefly referring to FIG. 1*c* and FIG. 1*d*, FIG. 1*c* is a bottom view of applicator 130 which comprises a seal 154 to provide a liquid tight seal between applicator 130 and housing 112. FIG. 1*d* is a bottom view of applicator 131 which comprises a seal 156 to provide a liquid tight seal between applicator 131 and reservoir 120.

Returning to FIG. 1 and FIG. 1*b*, reservoir 120 shown in FIG. 1*b* is located in housing 114 in a location defined by reservoir guides 122 (only three of four are visible in FIG. 1*b*) and is removable improving the convenience of filling it with product and cleanup when a hair care process has completed. Product can be preheated prior to placement in housing 112 or removable reservoir 120. Alternatively, removable reservoir 120 can be manufactured of a material safely used in a microwave oven in order to permit the microwave heating of product contained therein. Additionally, apparatus 100 can be made of entirely of materials safely used in a microwave oven, allowing for microwave heating of product after it is placed in housing 112.

In order to facilitate application of product at predetermined temperatures or temperature ranges, such as temperatures that are both safe for hair health and enhanced absorption by hair, housing 112 or reservoir 120 can be manufactured to comprise a thermochromatic material whereby the material of housing 112 or reservoir 120 provides a visual indication that such predetermined temperatures or temperature ranges are present. Alternatively, housing 112 or reservoir 120 can comprise a thermochromatic device 146 and 148, respectively, attached thereon, such as an adhesively attached thermochromatic label to provide such visual indication.

In operation during a hair care procedure, apparatus 100 and 101 may be made to interact with hair such that manipulators 142 of applicators 130 and 131, respectively, pass through hair to detangle, style, shape, enhance curls or otherwise manipulate the hair. The movement of apparatus 100 and 101 from a resting orientation where applicators 130 and 131 are generally horizontal and above housing 112 and reservoir 120, respectively, to a generally inverted through generally vertical orientation result in gravitational forces generating flow of product from housing 112 and reservoir 120 through holes 134 and 135 to the exposed applicator surfaces 132 and 134 of applicators 130 and 131, respectively, and product thereby becoming available for contact with and application to the hair during and concurrently with manipulation thereof.

Figure 2A:
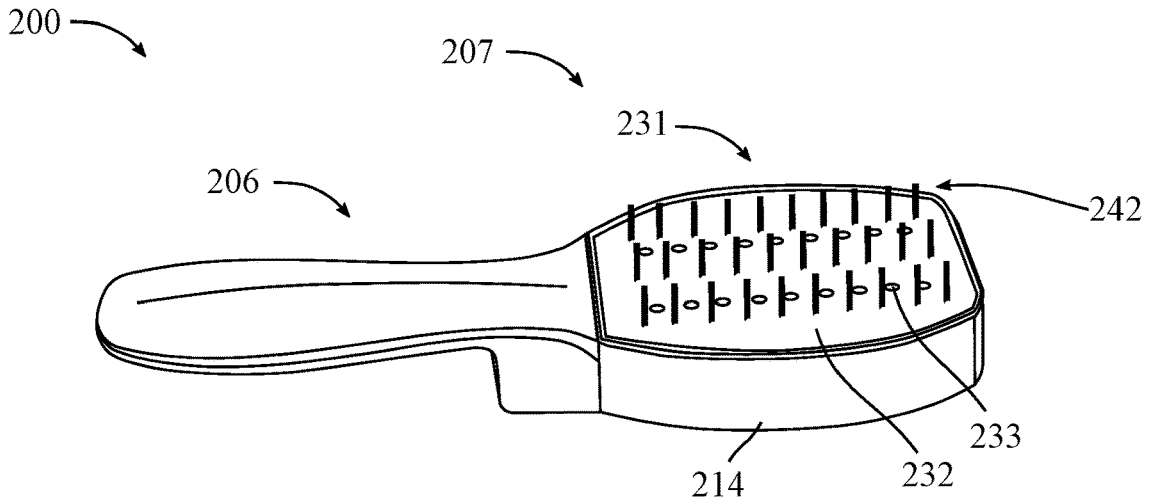
FIG. 2*a* is a perspective view of an illustrative embodiment with an internal heater.
Figure 2B:
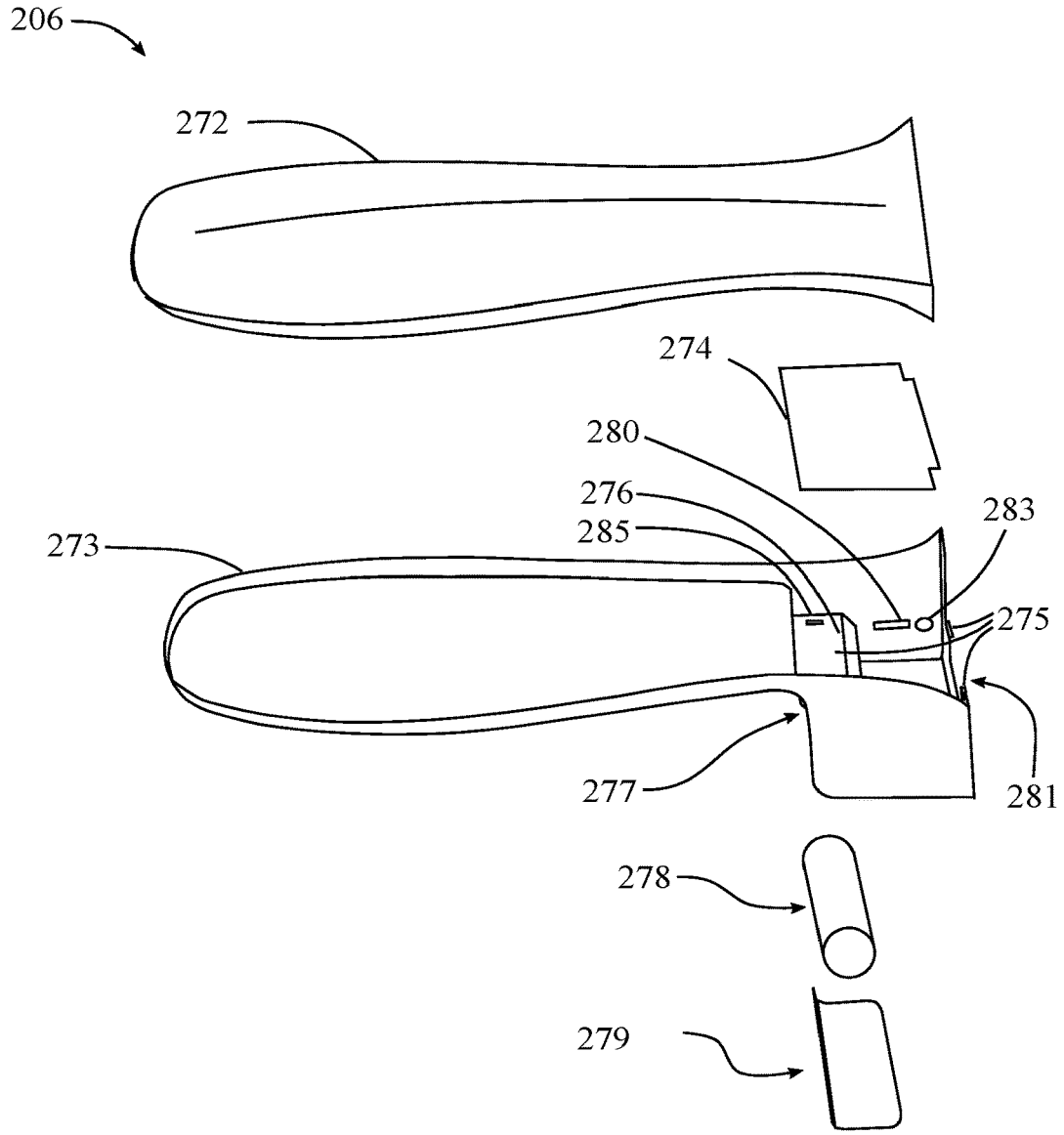
FIG. 2*b* is an exploded view of a handle of the embodiment of FIG. 2*a*.

FIG. 2*a* shows a perspective view of an illustrative embodiment of an apparatus 200 comprising an internal product heater. Apparatus 200 comprises a handle 206 and a head 207. Head 207 comprises a housing 214 and an applicator 231 removably attached thereto and comprising an exposed applicator surface 232, which comprises a plurality of holes 233, and a manipulator 242. FIG. 2*b* is an exploded view of handle 206 having an upper housing 272, a lower housing 273, a circuit board assembly 274, a battery 278 and a removable battery cover 279. Lower housing 273 further comprises circuit board mount points 275, a battery housing 276, a control opening 280 and an indicator opening 283. When mounted on mount points 275, battery terminals 284 of circuit board assembly 274, shown later in FIG. 2*d*, pass through battery terminal openings 285 (only one of two is visible in FIG. 2*b*) and are available in battery housing 276 for connection to battery 278 which is accessible through a battery access 277 when battery cover 279 is removed from lower housing 273.

Figure 2C:
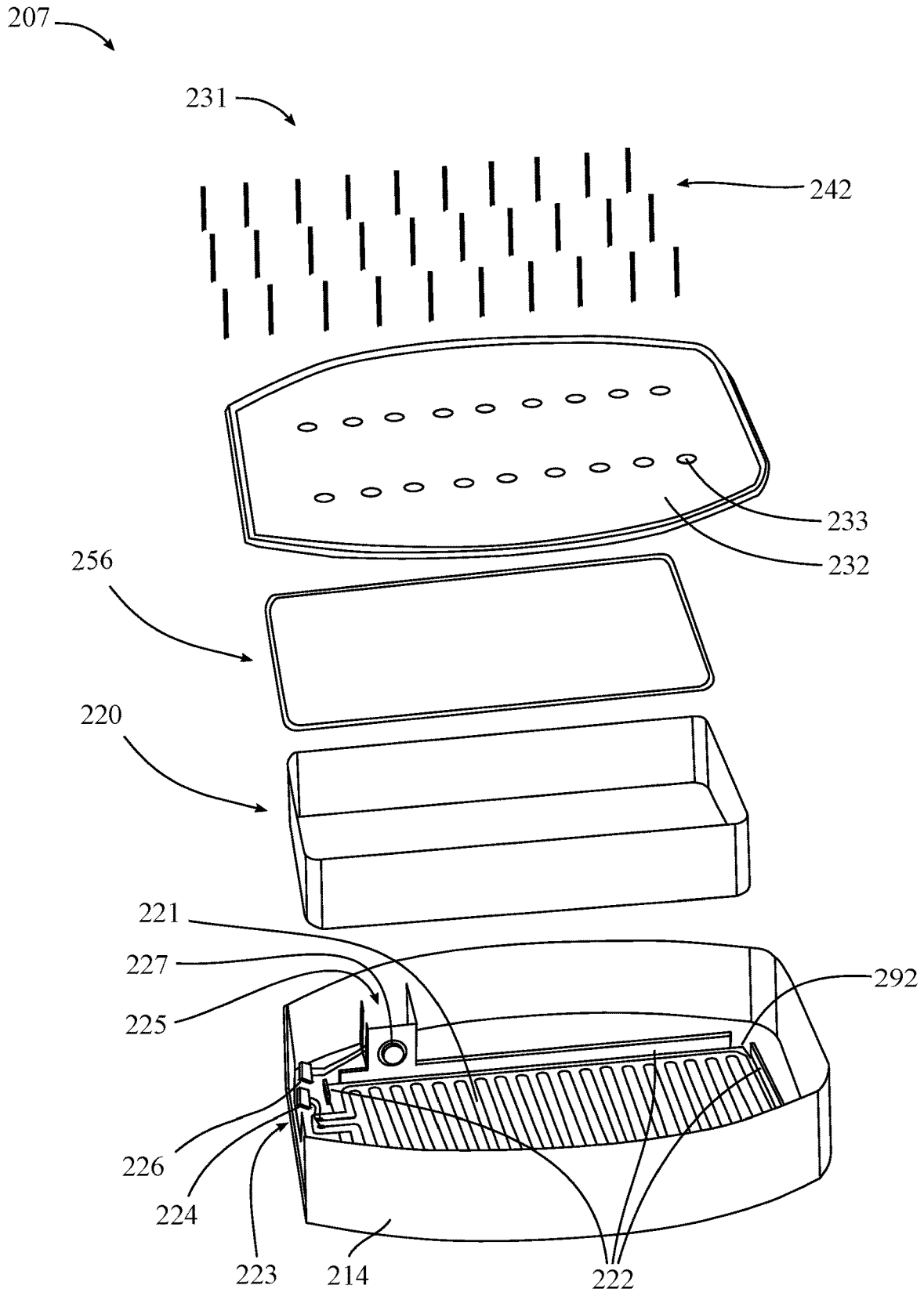
FIG. 2*c* is an exploded view of a head of the embodiment of FIG. 2*a*.

FIG. 2*c* is an exploded view of head 207 comprising applicator 231 comprising manipulator 242, exposed applicator surface 232 comprising holes 233 and a reservoir seal 256, a reservoir 220, which may also be referred to as a product vessel, and a housing 214. Housing 214 comprises a heating element 221 having a heating element connector 224 and may be situated above a heating element insulator 292, wherein both insulator 292 and element 221 can be bordered by reservoir placement guides 222 (only three of four are visible in FIG. 2*c*). Housing 214 further comprises a wiring cable access 223, a thermistor housing 225 and a thermistor 227 having a thermistor connector 226.

Figure 2D:
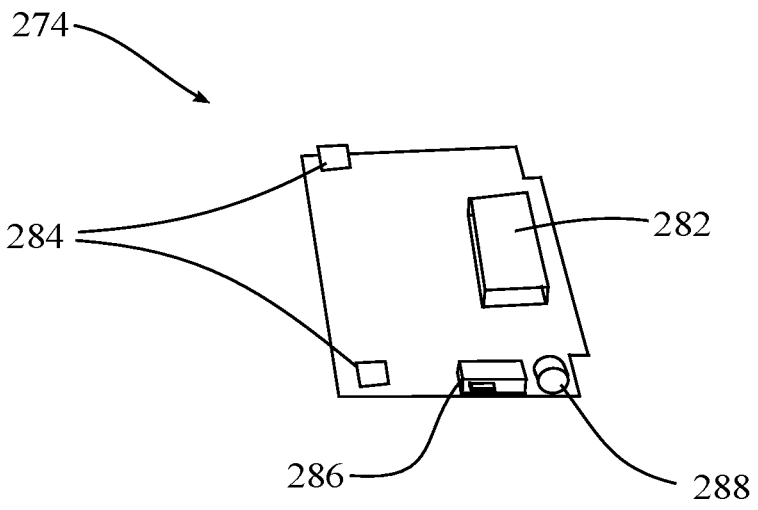
FIG. 2*d* is a view of a circuit board assembly of FIG. 2*b*.

Referring to FIG. 2*d* in conjunction with FIG. 2*c*, FIG. 2*d* is a bottom view of circuit board assembly 274 and illustrates battery terminals 284, a wiring cable connector 282, a control switch 286 and an LED indicator 288. Circuit board assembly 274 comprises a temperature regulation circuitry, not shown, operably coupled to thermistor 227 and heating element 221. Additionally referring to FIG. 2*b*, when circuit board assembly 274 is mounted on mount points 275, battery terminals 284 protrude into battery housing 276, as discussed previously, for connection to battery 278, and control switch 286 and LED 288 are operable and visible, respectively, through control opening 280 and indicator opening 283, respectively.

Figure 2E:
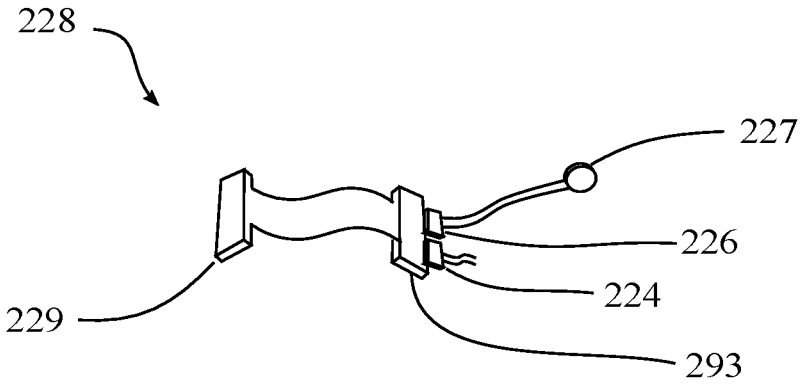
FIG. 2*e* is a view of a wiring cable of the embodiment of FIG. 2*a*.

Referring to FIG. 2*c*, FIG. 2*d* and FIG. 2*e*, FIG. 2*e* shows a wiring cable 228 for electrically interconnecting temperature regulation circuitry (not shown) on circuit board assembly 274, heating element 221 and thermistor 227. Cable 228 has a circuit board connector 229 for connection to wiring cable connector 282 of circuit board assembly 274. Cable 228 further comprises a device connector 293 for connection to heating element connector 224 and thermistor connector 226, wherein connectors 224 and 226 and thermistor 227 are shown in FIG. 2*e* for illustration.

Referring to FIG. 2*a*, FIG. 2*b* and FIG. 2*c*, a user of apparatus 200 removes applicator 231 from housing 214 thereby exposing reservoir 220. The user can remove reservoir 220 to facilitate disposing product therein, and afterwards return reservoir 220 to the location defined by reservoir guides 222 and on top of heating element 221, wherein reservoir 220 is in thermal contact with heating element 221, product disposed therein and thermistor 227. Reservoir 220 can be made of a metal to efficiently conduct heat generated by heating element 221 to product disposed therein. Alternatively reservoir 220 can be manufactured of a polymer engineered to conduct heat. Once product is in reservoir 220, applicator 231 may be reattached to housing 214 sealing reservoir 220 to applicator 231 with seal 256. To initiate heating of product, switch control 286 is positioned to an "on" position thereby causing power from battery 278 to be supplied to circuitry residing on circuit board assembly 274. If the resistance of thermistor 227 has not achieved a value to indicate a predetermined target product temperature has been reached, power from battery 278 is supplied by circuit board assembly 274 via wiring cable 228 to heating element 221. If the thermistor 227 resistance indicates a predetermined target temperature is present (or is exceeded), power is not supplied to heating element 221. Switch control 286 can include additional position settings such that multiple settings corresponding to multiple target temperature levels can be provided, such as a high and low temperature setting. Predetermined temperatures may be established such that product temperatures that are safe for hair health while enhancing product absorption are provided.

LED 288 can comprise more than one color capability and be activated to emit one color to indicate apparatus 200 is on and product is heating (e.g. red) and another color to indicate apparatus 200 is on and product is not heating (e.g. green), and more specifically, to indicate that product has achieved a desired temperature level and is ready for application.

In operation during a hair care procedure, apparatus 200 may be made to interact with hair such that the manipulator 242 passes through the hair to detangle, style, shape, enhance curls or otherwise manipulate the hair. The movement of apparatus 200 from a resting orientation where applicator 231 is generally horizontal and above reservoir 220, to a generally inverted through generally vertical orientation, results in gravitational forces generating flow of heated product, having a predetermined safe and absorption enhancing temperature, from reservoir 220 through holes 233 to the exposed applicator surface 232 of applicator 231, and heated product thereby becoming available for contact with, application to, and indirect heating of the hair during and concurrently with manipulation thereof.

Figure 3A:
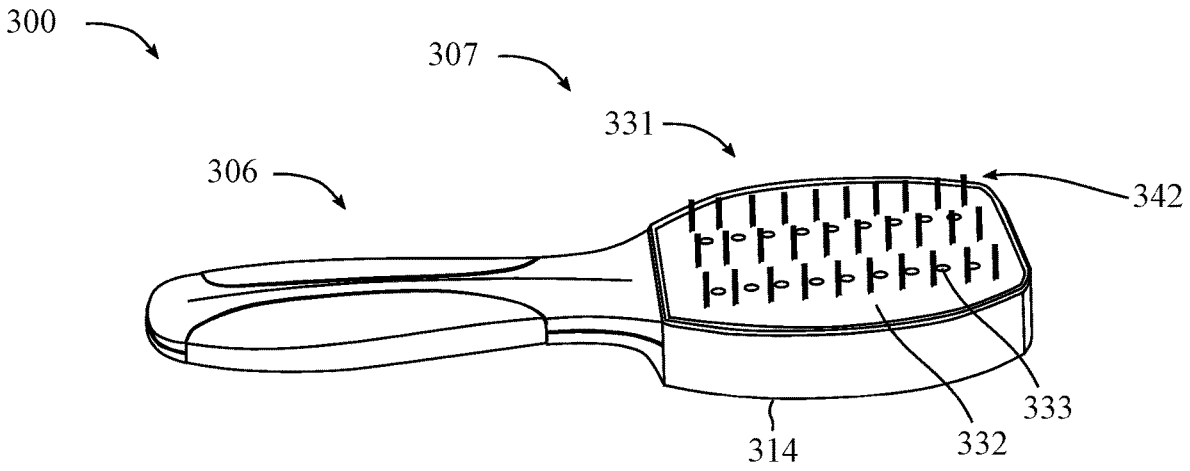
FIG. 3*a* is a perspective view of an illustrative embodiment with a pump.
Figure 3B:
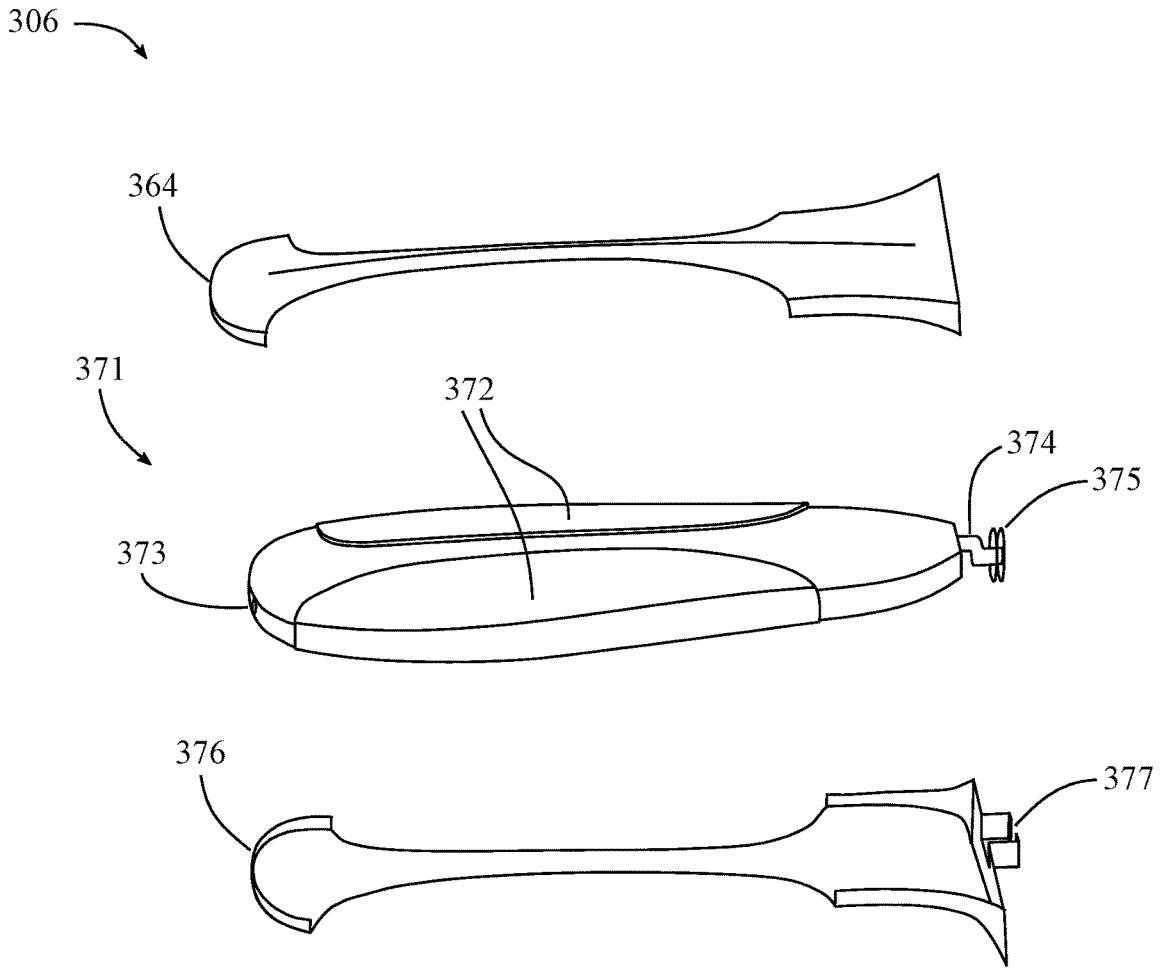
FIG. 3*b* is an exploded view of a handle of the embodiment of FIG. 3*a*.

FIG. 3*a* shows a perspective view of an illustrative embodiment of an apparatus 300 comprising a product pump. Apparatus 300 comprises a handle 306 and a head 307. Head 307 comprises a housing 314 and an applicator 331 removably attached thereto and comprising a manipulator 342 and an exposed applicator surface 332 which comprises a plurality of holes 333. FIG. 3*b* is an exploded view of handle 306. Handle 306 comprises an upper housing 364, a squeezable air filled pump 371 comprising squeezable sides 372, a pump inlet check valve 373, a pump outlet 374 and outlet flange 375, and a lower housing 376 comprising an outlet flange housing 377.

Figure 3C:
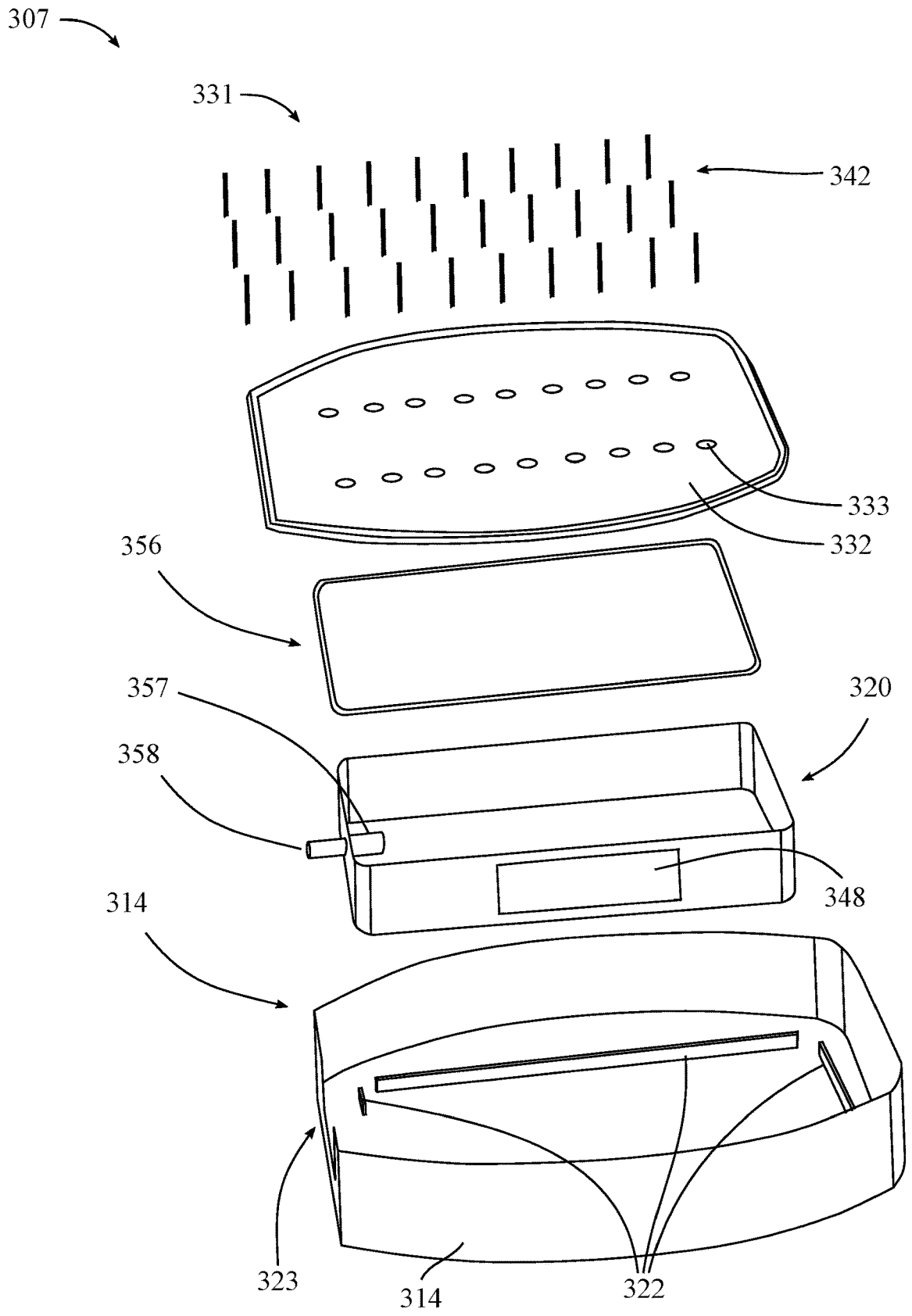
FIG. 3*c* is an exploded view of a head of the embodiment of FIG. 3*a*.

FIG. 3*c* is an exploded view of head 307 comprising applicator 331 comprising manipulator 342, exposed applicator surface 332 which comprises holes 333, and a reservoir seal 356. Head 307 further comprises a reservoir 320, which may also be referred to as a product vessel, comprising a pump outlet check valve 357 and a pump outlet connection tube 358, and housing 314 comprising reservoir placement guides 322 (only three of four are visible in FIG. 3*c*) and a pump outlet access 323. Reservoir 320 is removable improving the convenience of disposing product therein and cleanup when a hair care process has completed. Product can be preheated prior to placement in reservoir 320. Reservoir 320 can be manufactured of a material safely used in a microwave oven in order to permit the microwave heating of product contained therein. In order to facilitate the application of product at predetermined temperatures or temperature ranges, such as temperatures that are both safe for hair health and enhanced absorption by hair, reservoir 320 can be manufactured to comprise a thermochromatic material whereby the material of reservoir 320 provides a visual indication that such predetermined temperatures or temperature ranges are present. Alternatively, reservoir 320 can comprise a thermochromatic device 348 attached thereon, such as an adhesively attached thermochromatic label, to provide such visual indication.

Referring to FIG. 3*c* in conjunction with FIG. 3*b*, pump outlet connection tube 358 inserts into pump outlet 374 and provides an airtight seal thereto. Pump outlet check valve 357 and pump outlet connection tube 358 are attached to reservoir 320 to provide a seal thereto and one-way flow of air into reservoir 320 through outlet connection tube 358. Pump inlet check valve 373 provides one-way flow of air into pump 371. When squeezable sides 372 are squeezed, inlet check 373 valve blocks air flow and air is forced out of pump 371 through outlet 374, through pump outlet connection tube 358, through pump outlet check valve 357 and into reservoir 320. When squeezable sides 372 are relaxed, pump outlet check valve 357 prevents flow of air and product into pump 371, and inlet check valve 373 allows flow of air into pump 371 to replace air that has been displaced from within pump 371 and into reservoir 320.

Additionally referring to FIG. 3*a*, a user of apparatus 300 may remove applicator 331 from housing 314 thereby exposing reservoir 320. The user can remove reservoir 320 to facilitate disposing product therein and afterwards, insert connection tube 358 of reservoir 320 into pump outlet 374 which is secured in housing 377 by flange 375 and return reservoir 320 to the location defined by reservoir guides 322. As earlier noted, product can be preheated prior to placement in removable reservoir 320, or should removable reservoir 320 be manufactured of a material safely used in a microwave oven, microwave heating of product can be accomplished directly therein. Should reservoir 320 comprise a thermochromatic indicator such as a label 348, the user can ensure a safe and effective temperature for product use is present by a visual indication therefrom.

In operation during a hair care procedure, apparatus 300 may be made to interact with hair such that manipulator 342 passes through the hair to detangle, style, shape, enhance curls or otherwise manipulate the hair. The movement of apparatus 300 from a resting orientation where applicator 331 is generally horizontal and above reservoir 320, to a generally inverted through generally vertical orientation results in gravitational forces generating flow of product from reservoir 320 to applicator holes 333, whereupon the squeezing of pump sides 372 generates flow of air into reservoir 320, thereby generating an increase of pressure therein and displacing product from reservoir 320 through applicator holes 333 to exposed applicator surface 332 of applicator 331. As such, product thereby becomes available for contact with and application to the hair during and concurrently with manipulation thereof. Pump 371 of apparatus 300 thereby provides added control in the hair care procedure by allowing a user to expedite delivery of hair product by actuating pump 371 by squeezing pump sides 372.

Figure 4A:
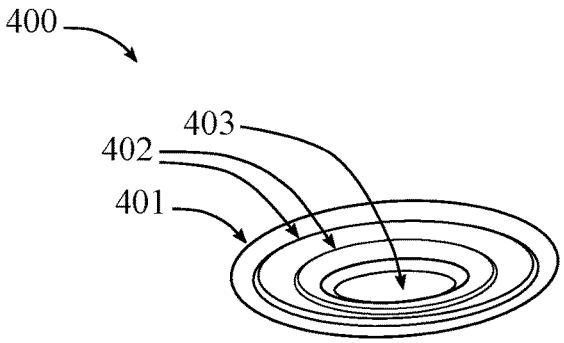
FIG. 4*a* is a perspective view of a possible configuration of a product retention well.

An exposed surface of an applicator, manipulator and/or other surface which contacts hair can comprise one or more product retention features such as a plurality of small well-like structures, ridges, troughs and/or raised perimeters which serve to retain excess product for subsequent transfer to hair. FIG. 4*a* shows a possible configuration for a product retention well 400 for retaining product comprising a bowl shaped outer area 401 comprising concentric ridges 402 and a central well 403. As a surface containing retention well 400 is moved through the hair during hair manipulation and product application, the bowl 401, ridges 402 and well 403 wipe excess product from hair and capture the excess product therein. When dryer hair is subsequently encountered by retention well 400, product retained therein may be transferred and applied to the dryer hair.

Figure 4B:
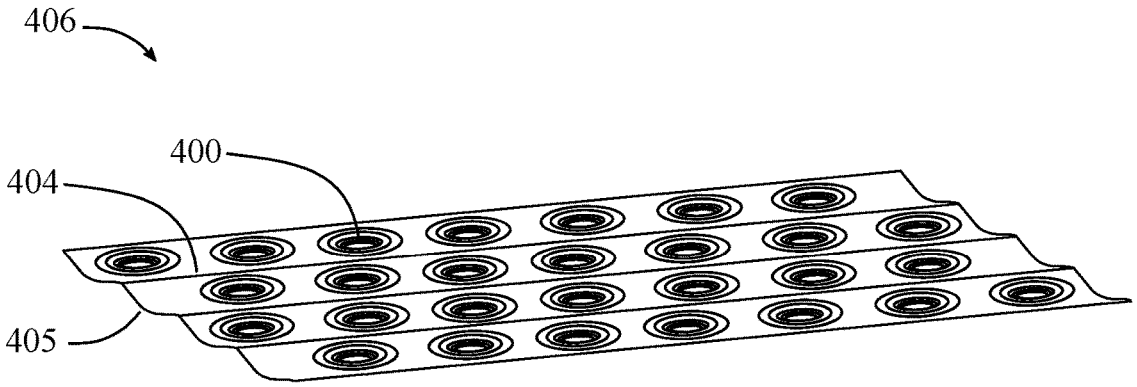
FIG. 4*b* is a perspective view of a possible configuration of a surface comprising product retention features.

FIG. 4*b* shows a possible configuration for a surface 406 comprising a plurality of product retention features comprising ridges 404 which form retention troughs 405. Retention troughs 405 further comprise a plurality of retention wells 400. As surface 406 containing retention features 404, 405 and 400 is moved through the hair during hair manipulation and product application, retention ridges 404 wipe excess product from hair and capture the excess product within retention troughs 405. Hair and gravitational forces may move excess product captured within retention troughs 405 to retention wells 400 which additionally wipe and capture product as described above. When dryer hair is subsequently encountered by retention troughs 405 and retention wells 400, product retained therein may be transferred and applied to the dryer hair.

Figure 4C:
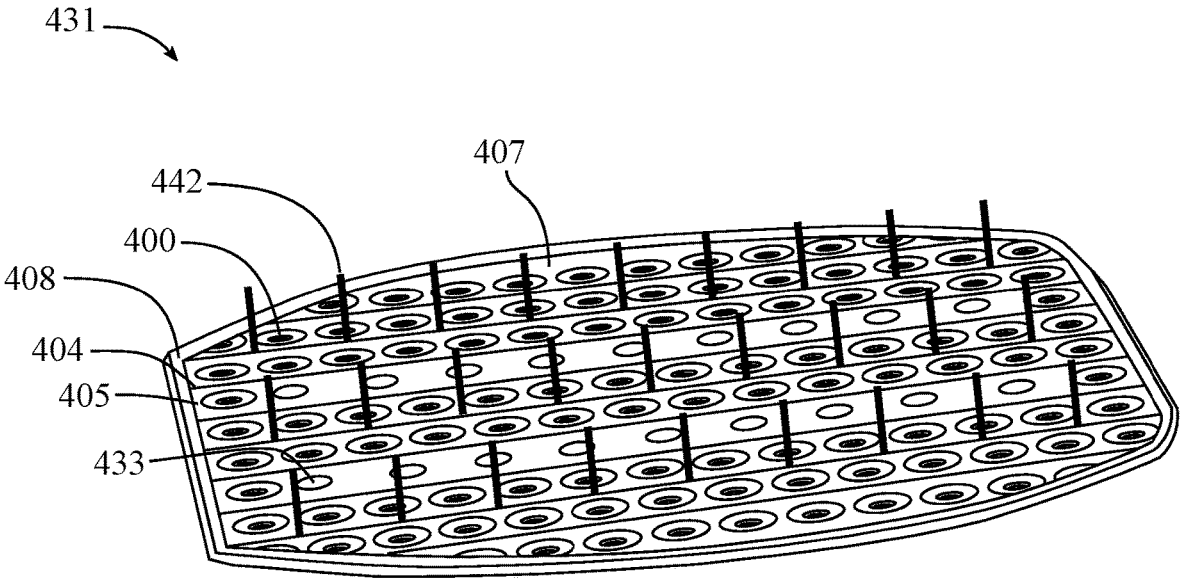
FIG. 4*c* is a perspective view of a possible configuration of an applicator comprising product retention features.

FIG. 4*c* shows a possible configuration of an applicator 431 comprising plurality of product retention features. Applicator 431 comprises an exposed applicator surface 407 bounded by a retention perimeter 408 formed by a raised perimeter of applicator 431. Applicator 431 further comprises a plurality of retention ridges 404 forming retention troughs 405. Retention troughs 405 comprise a plurality of retention wells 400. Applicator 431 additionally comprises a plurality of holes 433 in exposed applicator surface 407 through which product may flow, and a manipulator 442. As applicator 431 comprising retention features 408, 404, 405 and 400 is moved through hair to manipulate hair with manipulator 442 and apply product which may flow through holes 433, retention perimeter 406 may wipe excess product from hair and serves to retain excess product on the exposed applicator surface 407 of applicator 431. Furthermore, retention ridges 404 may wipe excess product from hair and capture the excess product within retention troughs 405. Additionally, hair and gravitational forces may move excess product captured within retention troughs 405 to retention wells 400 which may further wipe and capture product as described above. When dryer hair is subsequently encountered by exposed applicator surface 407 comprising product retention troughs 405 and retention wells 400, product retained thereon and therein may be transferred and applied to the dryer hair.

With the addition of product retention features, a surface which regularly contacts hair during a hair care process, other than an active applicator surface through which product flows, can serve as a passive applicator, whereby the passive applicator can collect, retain and apply excess product. In doing so, passive applicators can reduce product waste, by collecting excess product that may otherwise drip from the hair, and speed the application process by applying the excess product in addition to product being applied by an active applicator applying product directly therefrom A possible configuration of a passive applicator is disclosed later herein.

Figure 5A:
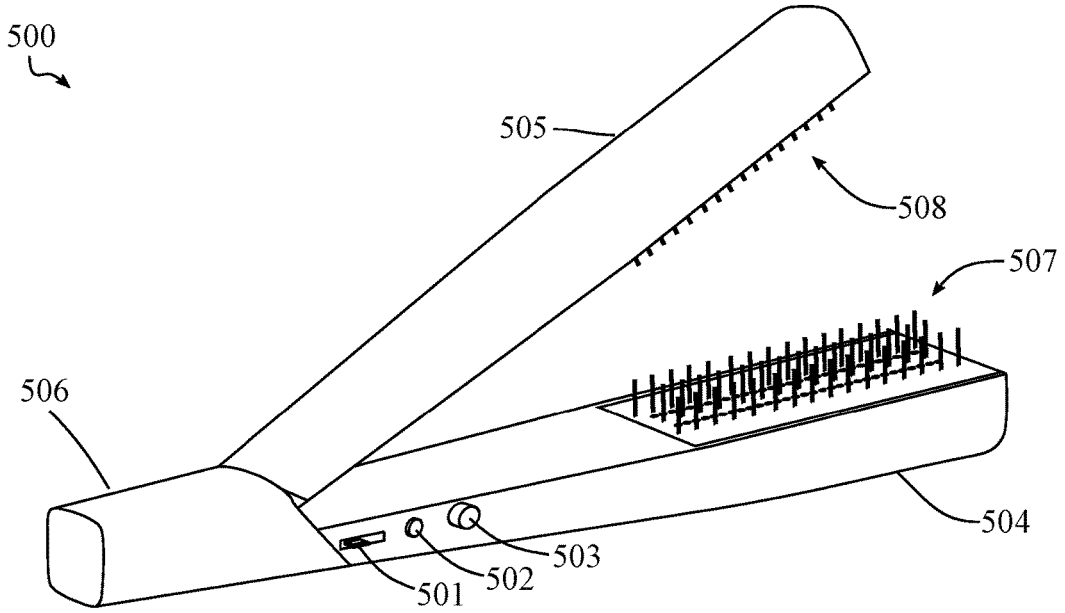
FIG. 5*a* is a perspective view of an illustrative embodiment with opposing arms comprising an application head module and an opposing manipulator module.
Figure 5B:
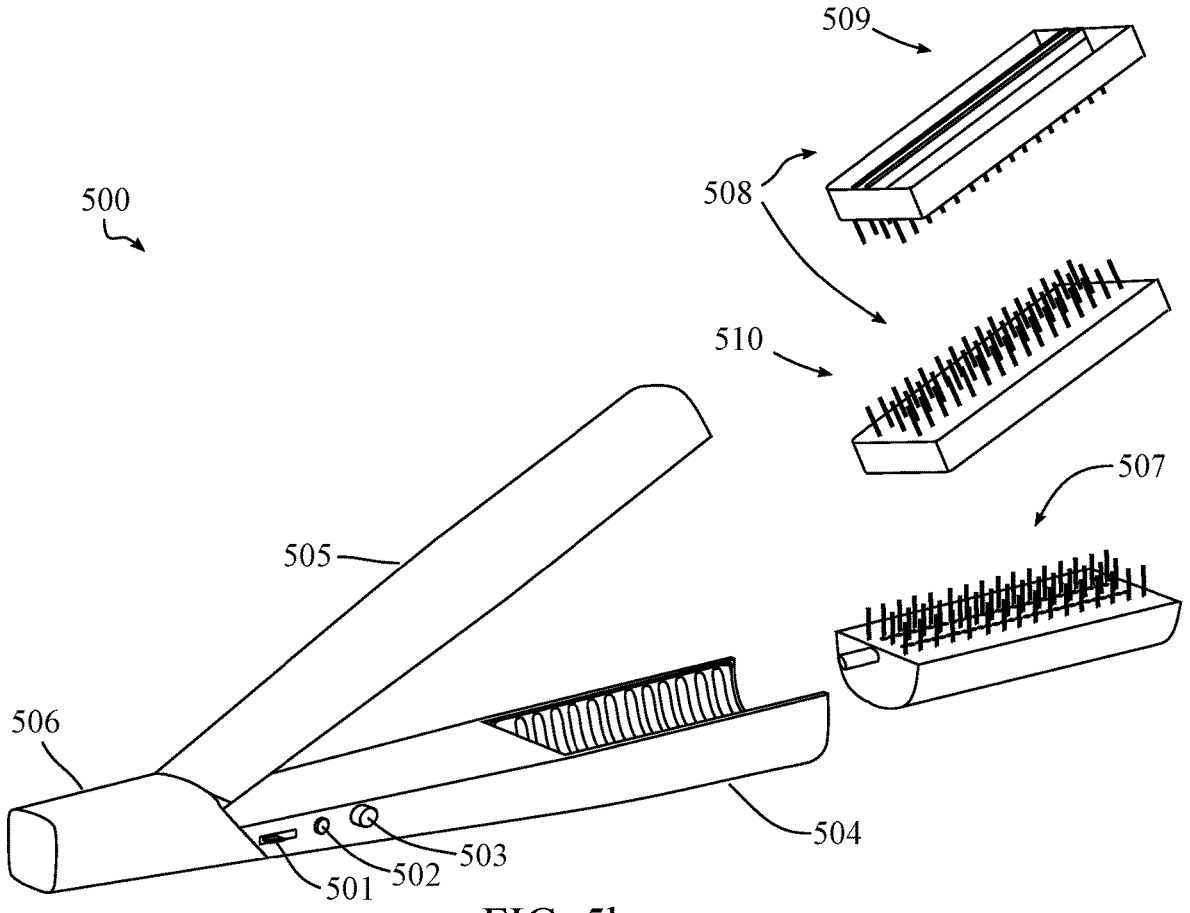
FIG. 5*b* is a perspective view of the embodiment of FIG. 5*a* with modules removed.
Figure 5C:
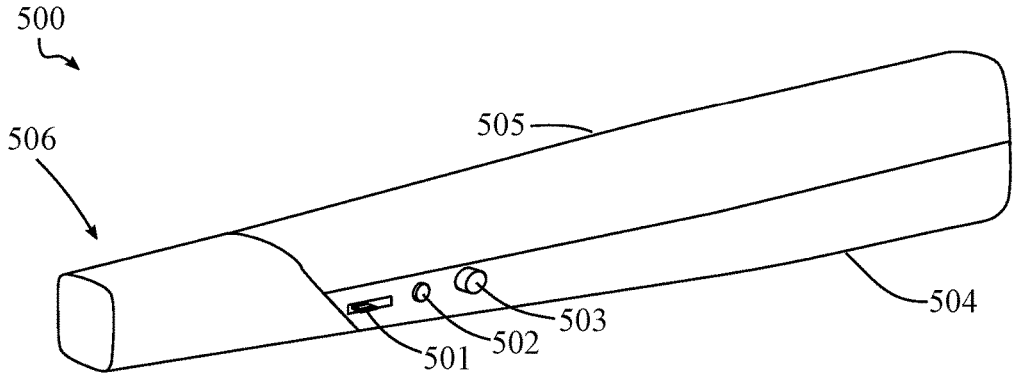
FIG. 5*c* is a perspective view of the embodiment of FIG. 5*a* with opposing arms closed.
Figure 5D:
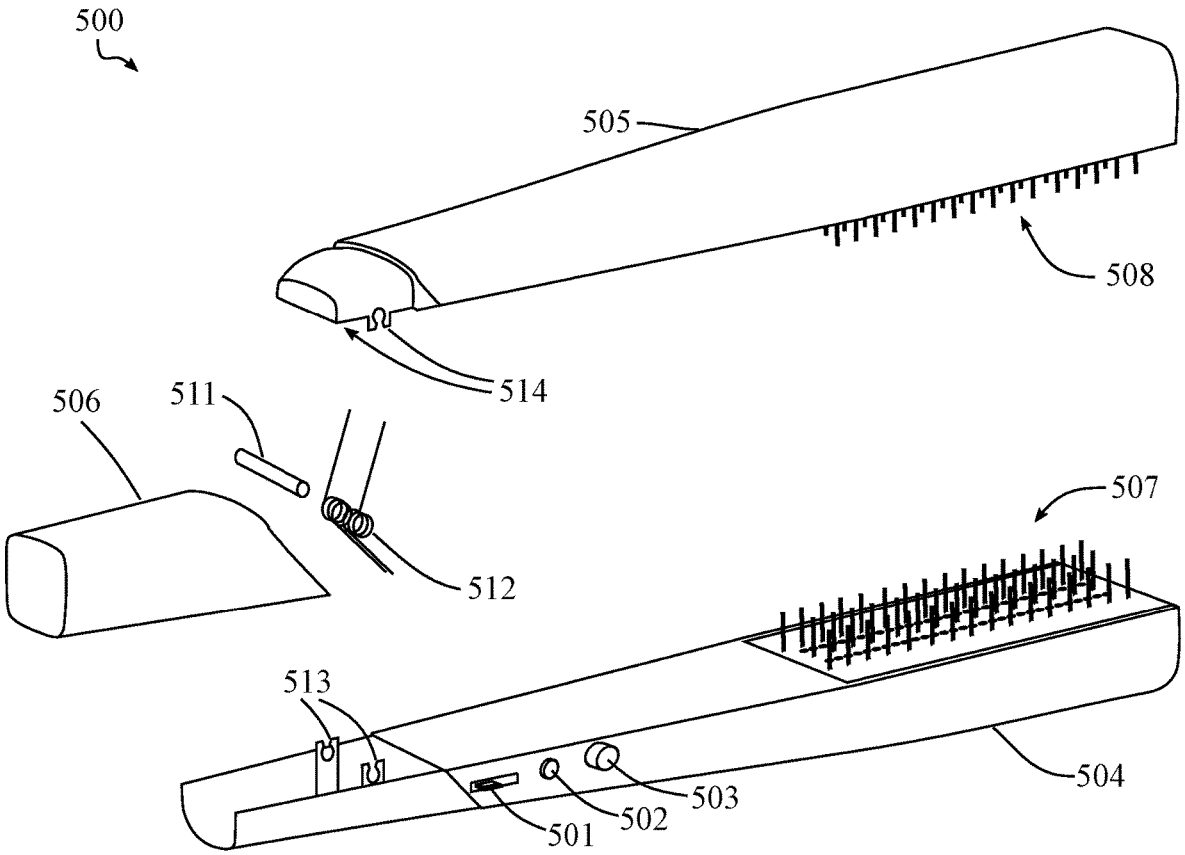
FIG. 5*d* is an exploded view of the embodiment of FIG. 5*a* with opposing arms detached from a pivot bar.

FIG. 5*a* illustrates a perspective view of an illustrative embodiment of an apparatus 500 comprising opposing arms pivotally attached on one end (a pivot end) thereby forming a clamp on the other end (a clamp end). Apparatus 500 comprises an application arm 504, an opposing arm 505, a pivot cap 506, an application head module 507 and an opposing manipulator module 508 (partially hidden). Apparatus 500 further comprises a control switch 501, an LED indicator 502 and an application control button 503. FIG. 5*b* illustrates a perspective view of apparatus 500 showing application head module 507 and opposing manipulator module 508 removed from application arm 504 and opposing arm 505, respectively. Opposing manipulator module 508 is shown in both a manipulation orientation 509 and a storage orientation 510. FIG. 5*c* is a perspective view of apparatus 500 when application arm 504 and opposing arm 505 are in a closed position. FIG. 5*d* depicts apparatus 500 in an exploded view with pivot cap 506 removed and arms 504 and 505 detached. Apparatus 500 further comprises a pivot bar 511 and a pivot spring 512. Pivot bar 511 slides through pivot spring 512 and is seated between pivot sockets 513 of application arm 504 and pivot sockets 514 (only one of two is visible in FIG. 5*d*) of opposing arm 505. Pivot spring 512 provides an opening force which radially separates application head 507 and opposing manipulator 508 of the clamp end of arms 504 and 505, about pivot bar 511 of the pivot end such that the user only has to apply or not apply a closing force to arms 504 and 505 to close and open the clamp end, respectively. The term clamp as it is used in this disclosure and in relation to the aforementioned configuration of moveably joined opposing arms 504 and 505 refers to a general structure and does not imply a clamping force is required or intended. In operation, when hair is captured in the clamp, it is generally loosely constrained such that the manipulators may be passed through the hair, and thus a clamping force and action, which can imply the hair is physically retrained rather that loosely constrained, is not present and is not desirable. Additionally, the manipulators present on the opposing faces of the clamp, as can be seen in FIG. 5*a*, prevent a full closure when the apparatus is in a configuration having opposing manipulator 508 in a manipulation orientation 509 (FIG. 5*b*) and requires opposing manipulator be inserted into opposing arm 505 in a storage orientation 510 for the clamp end to be fully closed as in FIG. 5*c*, which will be explained in more detail later herein.

Figure 5F:
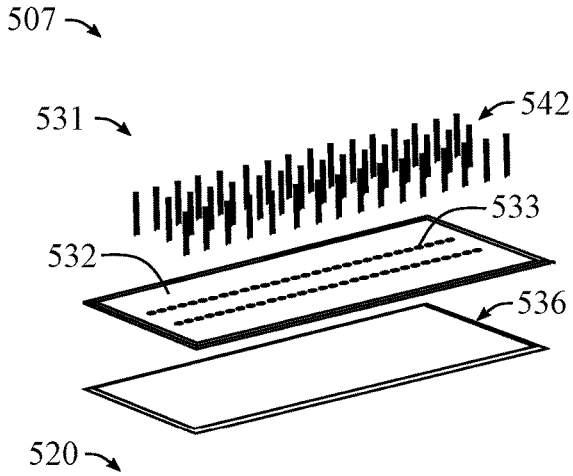
FIG. 5*f* is a perspective view of a product reservoir having product displacement vanes, wherein displacement vanes are in an open position.
Figure 5F:
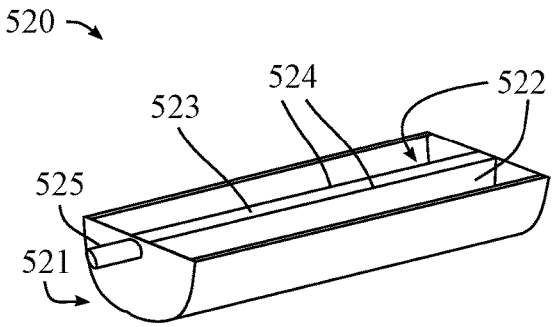
Figure 5E:
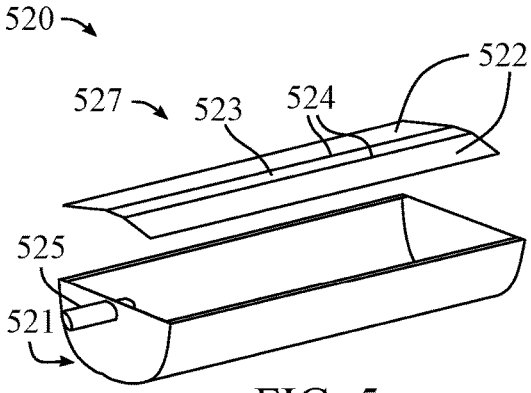
FIG. 5*e* is an exploded view of an application head module.

FIG. 5*e* illustrates an application head module 507 of apparatus 500 in an exploded view comprising an applicator 531 and a product reservoir 520, which may also be referred to as a product vessel. Applicator 531 is configured to be removably attached to product reservoir 520 and/or application arm 504 (FIG. 5*b*) in conjunction with reservoir 520, and comprises a manipulator 542, an exposed applicator surface 532 which comprises holes 533, and a seal 536. Reservoir 520 comprises a vane assembly 527 comprising vanes 522 attached by hinges 524 to a vane mounting bar 523 which is attached to a reservoir base 521 comprising an inlet 525. Inlet 525 comprises a check valve (not shown) which allows air to flow through inlet 525 in a direction into reservoir 520, but does not allow return flow through inlet 525 in a direction out of reservoir 520.

FIG. 5*f* shows a perspective view of product reservoir 520 comprising a reservoir base 521, product displacement vanes 522, vane mounting bar 523, vane hinges 524 and inlet 525. Base 521 has a cross sectional shape in the planes perpendicular to the long axis of vane mounting bar 523 comprising two quarter circles separated by the width of bar 523. Such separation creates two outermost tangentially connected points, one for each quarter circle, allowing reservoir 520 to remain upright when placed on a flat horizontal surface, and allows each hinge 524 to reside along the radial center line of one of the quarter cylinders defined by the cross section. Product displacement vanes 522 have a length and width of the inner dimensional length and radius, respectively, of the quarter cylinders of reservoir base 521 and, in FIG. 5*f*, are in an open position, projecting downward from hinges 524, thereby allowing the volume for each quarter cylinder of reservoir base 521 to be filled with product. FIG. 5*g* depicts a perspective view of product reservoir 520 where product displacement vanes 522 are in positions which have displaced a majority of an available volume for product within base 521. Vanes 522 have reached their maximum displacement position when they have reached vane stops 526.

Figure 5H:
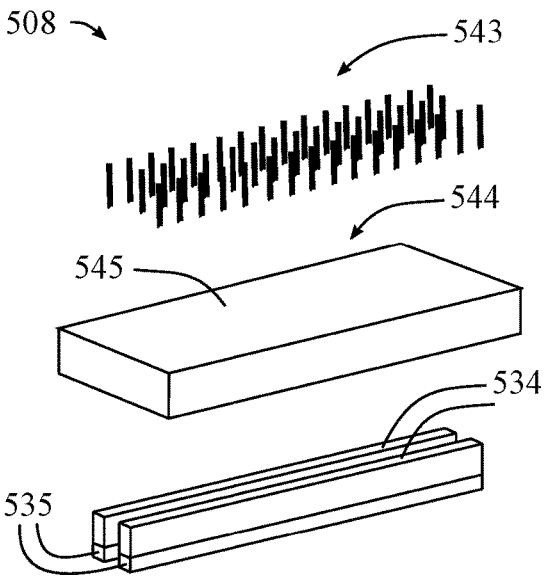
FIG. 5*h* is an exploded view of an opposing manipulator module.
Figure 5G:
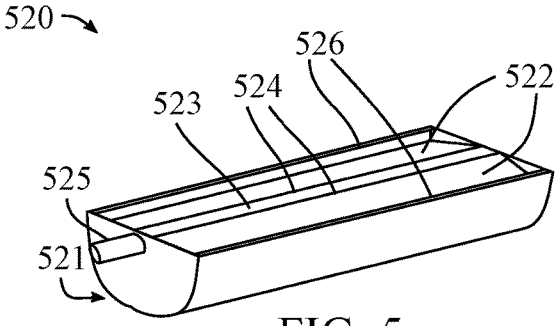
FIG. 5*g* is a perspective view of a product reservoir having product displacement vanes, wherein displacement vanes are in predominantly closed position.
Figure 5I:
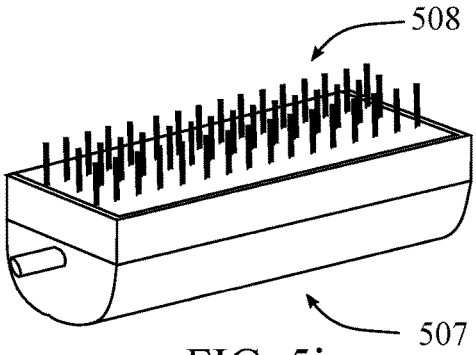
FIG. 5*i* is a perspective view of an opposing manipulator module and an application head module illustrating a storage relationship when opposing arms are in a closed position.
Figure 5J:
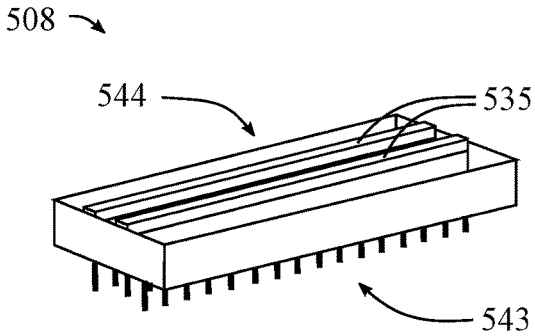
FIG. 5*j* is a perspective view of an opposing manipulator module comprising applicator seals and a storage recess area for an applicator manipulator.

FIG. 5*h* is an exploded view of an opposing manipulator module 508 comprising a manipulator 543, a base 544 comprising a surface 545, and applicator seals 534 comprising compressible edges 535. Referring to both FIG. 5*b* and FIG. 5*i*, FIG. 5*i* shows in perspective view, the relationship between opposing manipulator module 508 and application head module 507 when opposing manipulator module 533 is inserted in opposing arm 505 in storage orientation 510, application head module 507 is inserted in application arm 504 and arms 504 and 505 are in a closed position as shown in FIG. 5*c*. FIG. 5*j* shows a bottom view of opposing manipulator 508. When situated on head 507 as shown in FIG. 5*i*, compressible edges 535 pass through manipulator 542 and press against holes 533 thereby closing holes 533 and preventing any product contained in reservoir 520 from leaking through holes 533. In a reciprocal fashion, manipulator 542 passes through and around applicator seals 534 such that opposing manipulator module 508 provides a storage location for manipulator 542.

Figure 5K:
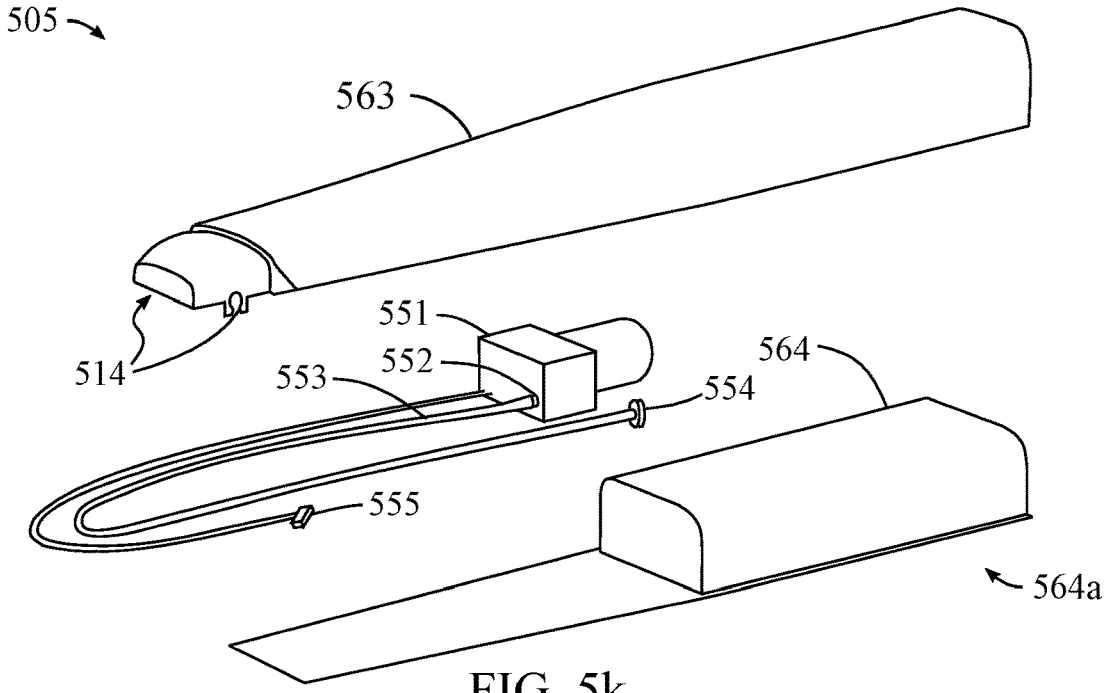
FIG. 5*k* is an exploded view of an opposing arm of the embodiment of FIG. 5*a*.
Figure 5L:
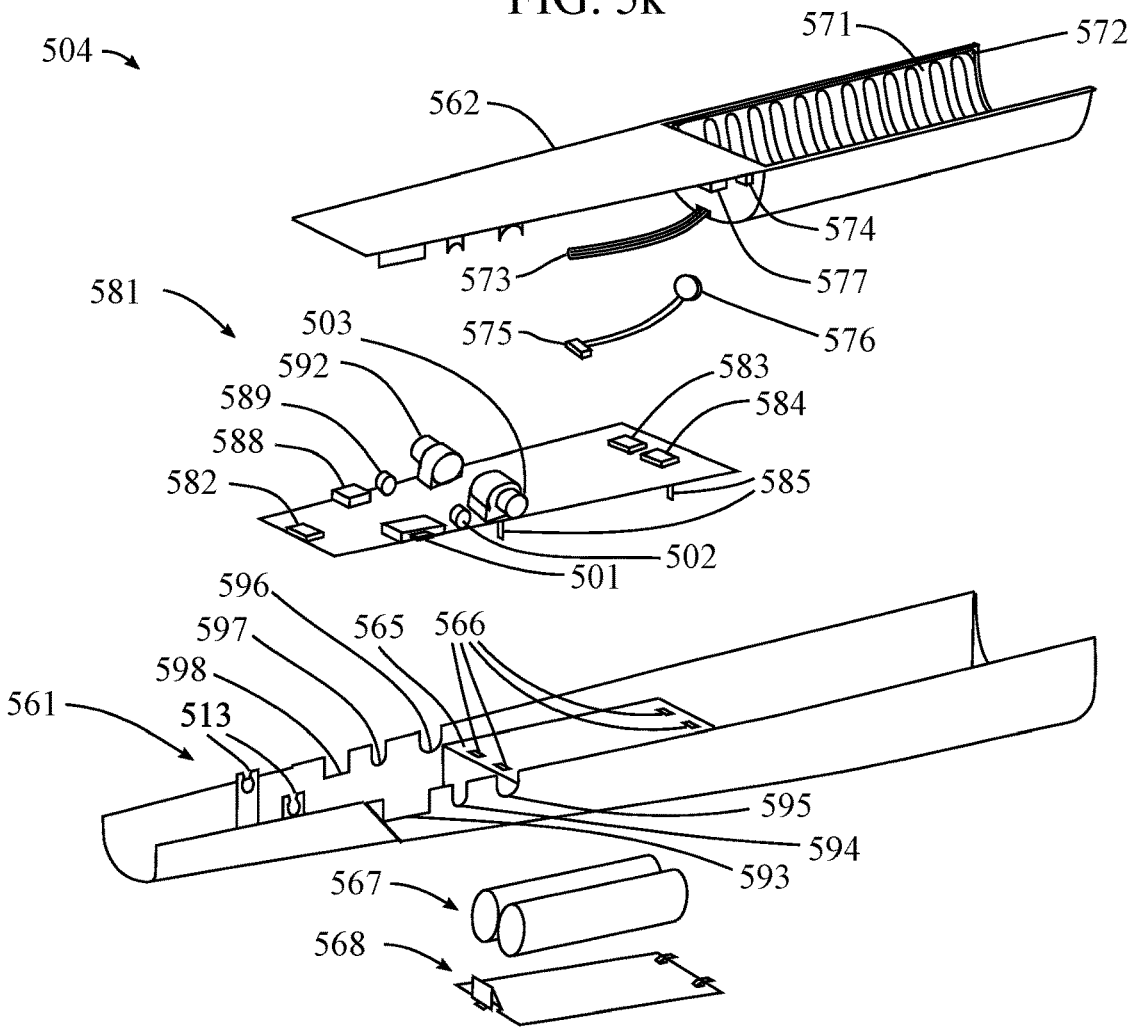
FIG. 5*l* is an exploded view of an application arm of the embodiment of FIG. 5*a*.

FIG. 5*k* and FIG. 5*l* are exploded views of arms 505 and 504, respectively, and do not show opposing manipulator 508 or application head 507 modules of FIG. 5*b*, respectively, nor pivot bar 511, pivot spring 512 and pivot cap 506 of FIG. 5*d*. FIG. 5*k* is an exploded view of opposing arm 505 comprising an outer housing 563 comprising pivot sockets 514 (only one of two is visible in FIG. 5*k*), an electric pump 551 comprising an outlet 552, a pump tube 553, which is connected to pump outlet 552 and comprises a pump tube flange 554, a pump electrical connector 555 and an inner housing 564 comprising a receptacle 564*a* for opposing manipulator 508.

FIG. 5*l* is an exploded view of application arm 504 comprising an inner housing 562, a circuit board assembly 581, an outer housing 561, rechargeable batteries 567 and a battery cover 568. Inner housing 562 comprises a heating element 571 and a heating element insulator 572. Heating element 571 comprises a connector 573 and is situated on heating element insulator 572. Inner housing 561 further comprises a pump tube flange housing 577 which receives pump tube flange 554 of FIG. 5*k*, and a thermistor housing 574 which receives a thermistor 576 having a connector 575. Circuit board assembly 581 comprises a pump connector 582, a heating element connector 583, a thermistor connector 584, battery terminals 585 (only two of four are visible in FIG. 5*l*), a switch 501, an on/heating LED indicator 502, a charging connector 588, a charging LED indicator 589, a first pump button switch 503 and a second pump button switch 592. Outer housing 561 comprises pivot sockets 513, a battery housing 565, battery terminal access holes 566, a switch opening 593, an on/heating LED opening 594, a first pump button switch opening 595, a second pump button switch opening 596, a charging LED opening 597 and a charging connector opening 598.

Referring to FIG. 5*b*, FIG. 5*e*, FIG. 5*k* and FIG. 5*l*, in operation, a user removes application head module 507 from application arm 504. Applicator 531 is configured to be removably attached to product reservoir 520 and/or application arm 504 in conjunction with reservoir 520. Applicator 531 is then removed from reservoir 520 and product is disposed therein. Application head module 507 is then reassembled by returning applicator 531 to reservoir 520, and collectively securing them as application head module 507 to application arm 504, which results in the insertion of reservoir inlet tube 525 into pump tube flange 554, and thermal contact between reservoir base 521, heating element 571, product disposed therein and thermistor 576. Switch 501 is positioned to an "on" position thereby causing power from rechargeable batteries 567 to be supplied to circuitry residing on circuit board assembly 581. If the resistance of thermistor 576 has not achieved a value to indicate a predetermined target product temperature has been reached, power from rechargeable batteries 567 is supplied by circuit board assembly 581 to heating element 571 via heating element connectors 583 and 573. If the thermistor 576 resistance indicates that a predetermined target temperature is present (or is exceeded), power is not supplied to heating element 571. Switch control 501 can include additional position settings such that multiple settings corresponding to multiple target temperature levels can be provided, such as a high and low temperature setting. Predetermined temperatures may be established such that product temperatures that are safe for hair health while enhancing product absorption are provided.

LED indicator 502 may be emit more than one color and emit a first color when apparatus 500 is on and thermistor 576 registers a temperature below a target temperature to indicate product is being heated. Once thermistor 576 registers that the target temperature has been reached and the heating element is no longer powered by rechargeable batteries 567 via circuitry on circuit board assembly 581, LED indicator 502 may emit a second color to indicate apparatus 500 is on and product has reached the target temperature and is ready for application.

During a hair care procedure, apparatus 500 is caused to interact with hair. A section of hair may be placed between the application head module 507 and opposing manipulator module 508 located on the clamp end of apparatus 500. Opposing arms 504 and 505 can be drawn together to establish a desired distance between modules 507 and 508. The clamp can be moved along the section of hair captured therein such that manipulators 542 and 543 (FIG. 5*h*) of modules 507 and 508, respectively, pass through the hair to detangle, style, shape, enhance curls or otherwise manipulate the hair. When a user wishes to apply product to their hair, either pump button switch 503 or 592 may be pressed, depending on convenience and which hand is being used to grasp apparatus 500, thereby causing circuitry on circuit board assembly 581 to supply power from rechargeable batteries 567 to pump 551 via pump connectors 582 and 555 thereby causing air pressure and air to flow from pump 551 through pump outlet 552, through tube 553, through flange 554, through reservoir inlet 521 and into reservoir 520. As air moves into reservoir 520, pressure is generated causing displacement vanes 522 to rotate on displacement vane hinges 524, thereby decreasing the available volume in reservoir base 521 for product contained therein. As the volume is reduced by an amount, an equivalent amount of product, which may be heated to a predetermined safe temperature, passes through applicator holes 533 of applicator 531 of application head module 507 to exposed applicator surface 532 and is made available for contact with, application to, and indirect heating of the hair during and concurrently with manipulation thereof. When the user ceases press one of the pump button switches 503 and 592, power to pump 551 ceases and air pressure and flow into reservoir 520 ceases, and further product displacement through applicator holes 533 ceases. Check valve (not shown) of inlet 525 of reservoir 520 prevents a return flow and may alternatively be comprised in pump 521 or as a redundant measure in both inlet 525 and pump 521.

Rechargeable batteries 567 can be charged by connecting charging connector 588 to a power source such as a USB connector (not shown) using a charging cable (not shown). When connected to a charging source, charging LED indicator 589 can emit a color to indicate rechargeable batteries 567 are charging and emit a different color to indicate when rechargeable batteries 567 are fully charged.

In an embodiment comprising a clamp similar to the apparatus of 500, many configurations are possible. For example, an opposing arm may or may not be configured with an opposing manipulator. The opposing arm will serve to capture hair between itself and an application arm regardless of an opposing manipulator being present. Alternatively, an application module may be configured such as not to comprise a manipulator and an opposing manipulator may be present. Varying styles of manipulators and combinations thereof may be used. For example, a user may find their particular hair characteristics are best managed by using a broadly spaced, large tooth manipulator geometry comprised by an applicator, and a tightly spaced, finer bristle on an opposing manipulator module. The user may find that the large tooth applicator manipulator can be favored when detangling and applying an initial application of product, and a tighter closure of the clamp and a combined emphasis of both manipulators is expeditious to distribution of product and finer manipulation of a section of hair once detangled and an initial application of product is disposed thereon. Furthermore, such a tooth geometry of an applicator manipulator may provide less resistance to an intimate contact between some hair types and the applicator surface, whereas a finer bristle geometry on an opposing manipulator will be effective is directing hair to the surface of the applicator when the clamp is drawn closer together.

An apparatus may be marketed with a plurality of manipulator options and geometries. An apparatus may use applicator manipulators and opposing manipulators which are interchangeable. Referring to FIG. 5*e* and FIG. 5*h*, an opposing manipulator base 544 may be alternatively configured to receive an applicator 531 having a manipulator 542 in lieu of manipulator 543. While there is no general function to holes 533 and seal 536 of an applicator 531 when so used, a reduction in unique parts to be manufactured, inventoried and distributed may be achieved by the manufacturer and product distributors, and the user of an apparatus may have fewer unique parts to purchase and manage while still achieving a higher degree of configurability.

Figure 6A:
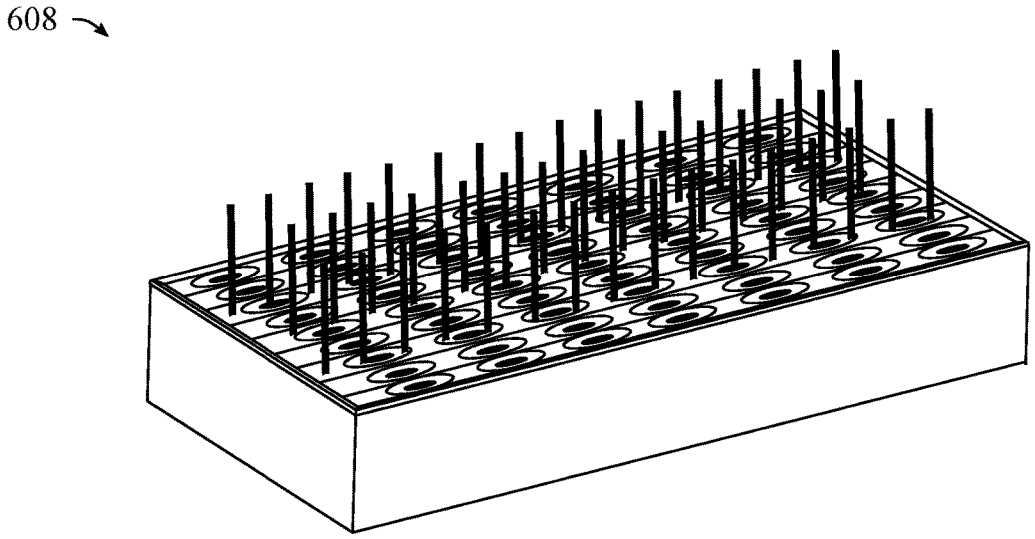
FIG. 6*a* is a perspective view of a possible configuration of a passive applicator module.
Figure 6B:
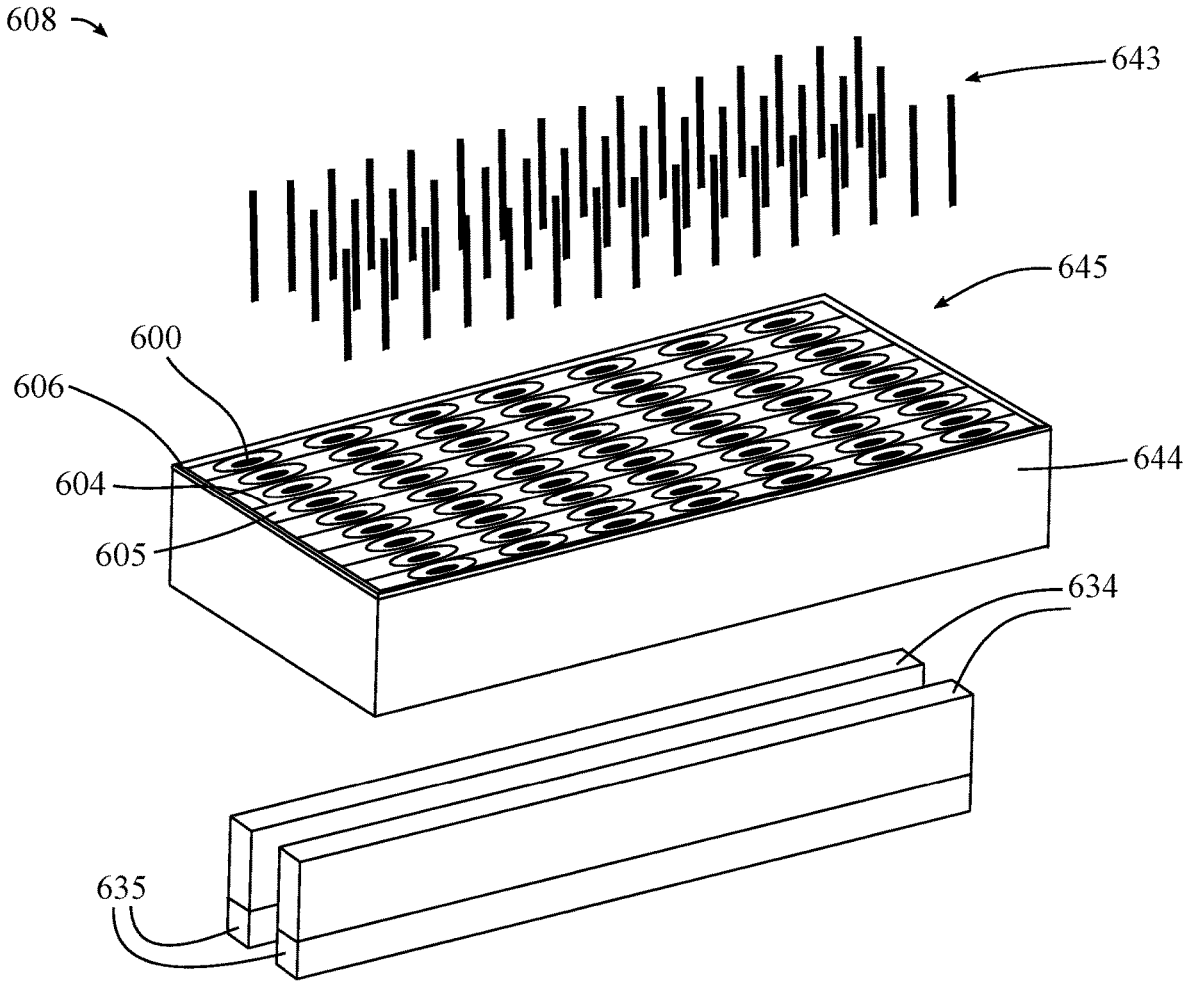
FIG. 6*b* is an exploded view of the passive applicator module of FIG. 6*a*.

As described in conjunction with FIG. 4*a*, FIG. 4*b* and FIG. 4*c*, any surface with which hair may come into contact, may comprise product retention features such that excess product is retained thereon and therein, and may be subsequently applied to dryer hair encountered thereby. For example, a surface of an opposing manipulator module may comprise product retention features. In such a configuration, the opposing manipulator module is a passive applicator module and speeds the product application process by retaining and applying excess product. FIG. 6*a* depicts an illustrative passive applicator module 608 which can be used in conjunction with apparatus 500 and be inserted in opposing arm 505 in place of an opposing manipulator module 508 (see FIG. 5*b*). In such a configuration, passive applicator module 608 is opposing active application head module 507. FIG. 6*b* depicts an exploded view of passive applicator module 608 comprising a manipulator 643, a base 644 comprising a surface 645 and applicator seals 634 comprising compressible edges 635. Surface 645 comprises a retention perimeter 606 formed by a raised perimeter of passive applicator module surface 645. Passive applicator module surface 645 further comprises a plurality of retention ridges 604 forming retention troughs 605. Retention troughs 605 comprise a plurality of retention wells 600. As passive applicator module 608 comprising retention features 606, 604, 605 and 600 is moved through hair to manipulate hair with manipulator 643, retention perimeter 606 may wipe excess product from hair received from application head module 507 and serves to retain excess product on the surface of passive applicator module 608. Furthermore, retention ridges 604 may wipe excess product from hair received from application head module 507 and capture the excess product within retention troughs 605. Additionally, hair and gravitational forces may move excess product captured within retention troughs 605 to retention wells 600 which may further wipe and capture excess product received from application head module 507. When dryer hair is subsequently encountered by surface 645 and product retention troughs 605 and retention wells 600, product retained thereon and therein, respectively, may be transferred and applied to the dryer hair. As such, as hair which is captured in the clamp passes through and between passive applicator module 608 and the active applicator of the application head module 507, it receives product from both sides of the clamp, thereby speeding the product application process.

Similar to the aforementioned alternate configuration of opposing manipulator base 544 (FIG. , passive applicator base 644 of passive applicator module 608 may be alternatively configured to receive an applicator 531 having a manipulator 542 in lieu of manipulator 643 (FIG. 5*e* and FIG. 6*b*). While there is no general function to holes 533 and seal 536 of an applicator 531 when so used, a reduction in unique parts to be manufactured, inventoried and distributed may be achieved by the manufacturer and product distributors, and the user of an apparatus may have fewer unique parts to purchase and manage while still achieving a higher degree of configurability.

In an alternate embodiment, multiple applicators can be configured wherein the opposing manipulator module 508 or passive applicator module 608 is instead a second active application head module. In such an embodiment, the rate of application may be further increased as both sides of a section of hair captured within the clamp can receive an active flow of product. Furthermore, two different types of product can be applied concurrently. For example, an individual may apply a favorite hair nourishing product and a favorite hair moisturizing product concurrently.

Figure 7A:
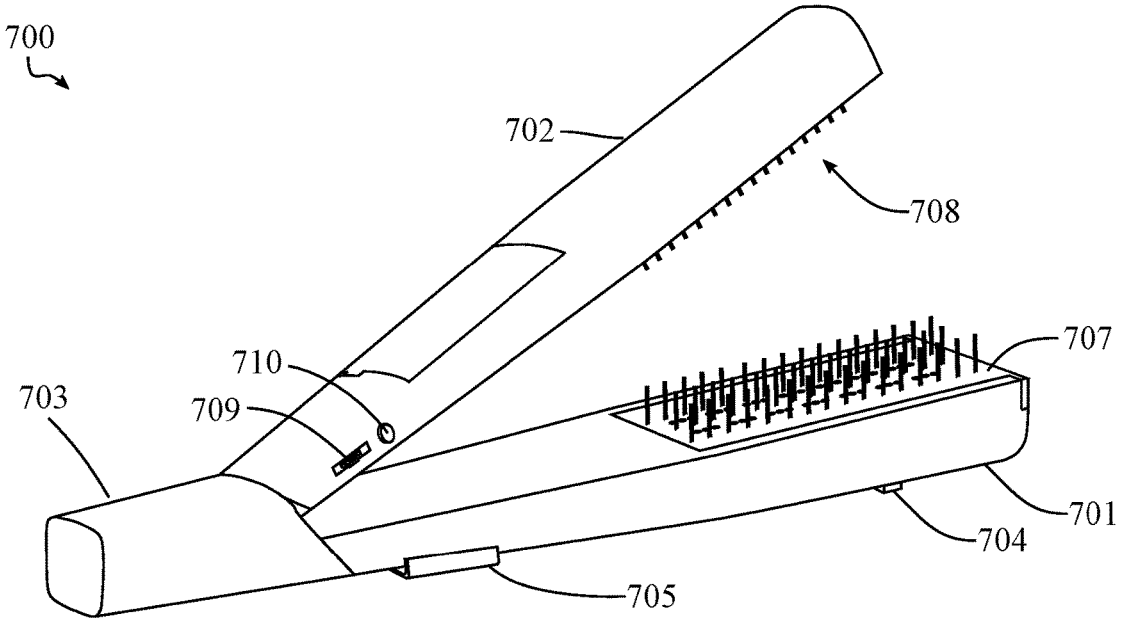
FIG. 7*a* is a perspective view of an illustrative embodiment with opposing arms comprising an application and on-demand heating module, an opposing manipulator module and a piston driven product cartridge dispensing system.
Figure 7B:
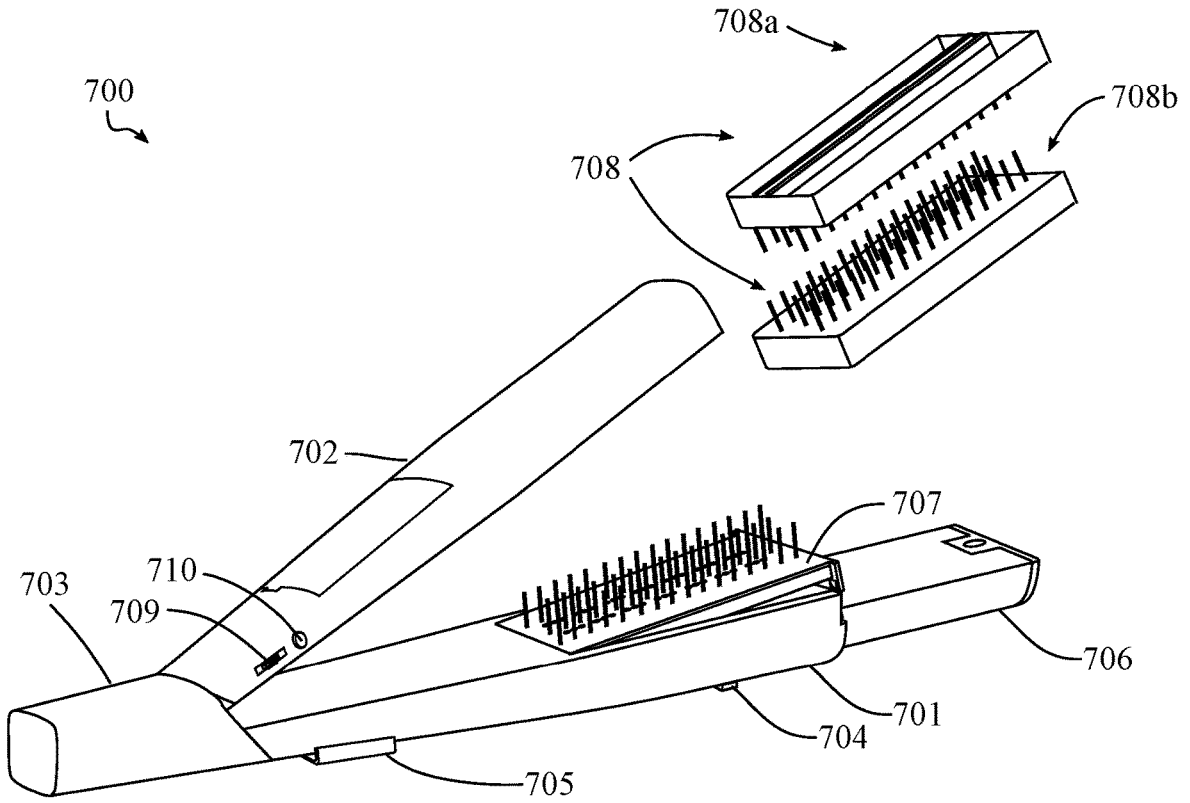
FIG. 7*b* is a perspective view of the embodiment of FIG. 7*a* with an application and on-demand heating module in an open position, a product cartridge and shell assembly partially removed, and an opposing manipulator module depicted in a removed position and in both manipulation and storage orientations.

FIG. 7*a* depicts a perspective view of an illustrative embodiment of an apparatus 700 comprising opposing arms pivotally attached on one end (pivot end) thereby forming a clamp on the other end (clamp end) similar to apparatus 500 of FIG. 5*a*, and also similarly comprises an application arm 701, an opposing arm 702, a pivot cap 703 and an opposing manipulator module 708 (partially hidden). Dissimilar to apparatus 500, apparatus 700, comprises an application and on-demand heating module 707, and a spring driven piston, not visible in FIG. 7*a*, and further comprises a piston retraction lever 704 and a piston release bar 705, wherein the spring driven piston can be used to create a flow of product from a prepackaged or user Tillable product cartridge, also not visible in FIG. 7*a*. Apparatus 700 also comprises a switch 709 and an LED indicator 710. FIG. 7*b* provides another perspective view of apparatus 700 showing opposing manipulator module 708 removed from opposing arm 702. Opposing manipulator 708 is shown in both a manipulation orientation 708*a* and a storage orientation 708*b*. FIG. 7*b* additionally shows application and on-demand heating module 707 in a raised or open orientation allowing removal (and insertion) of a product cartridge shell assembly 706 from (into) application arm 701.

Figure 7C:
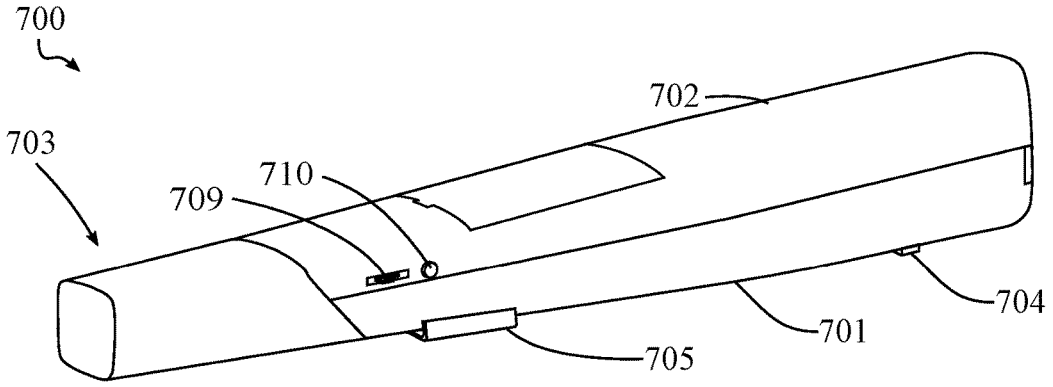
FIG. 7*c* is a perspective view of the embodiment of FIG. 7*a* with opposing arms closed.
Figure 7D:
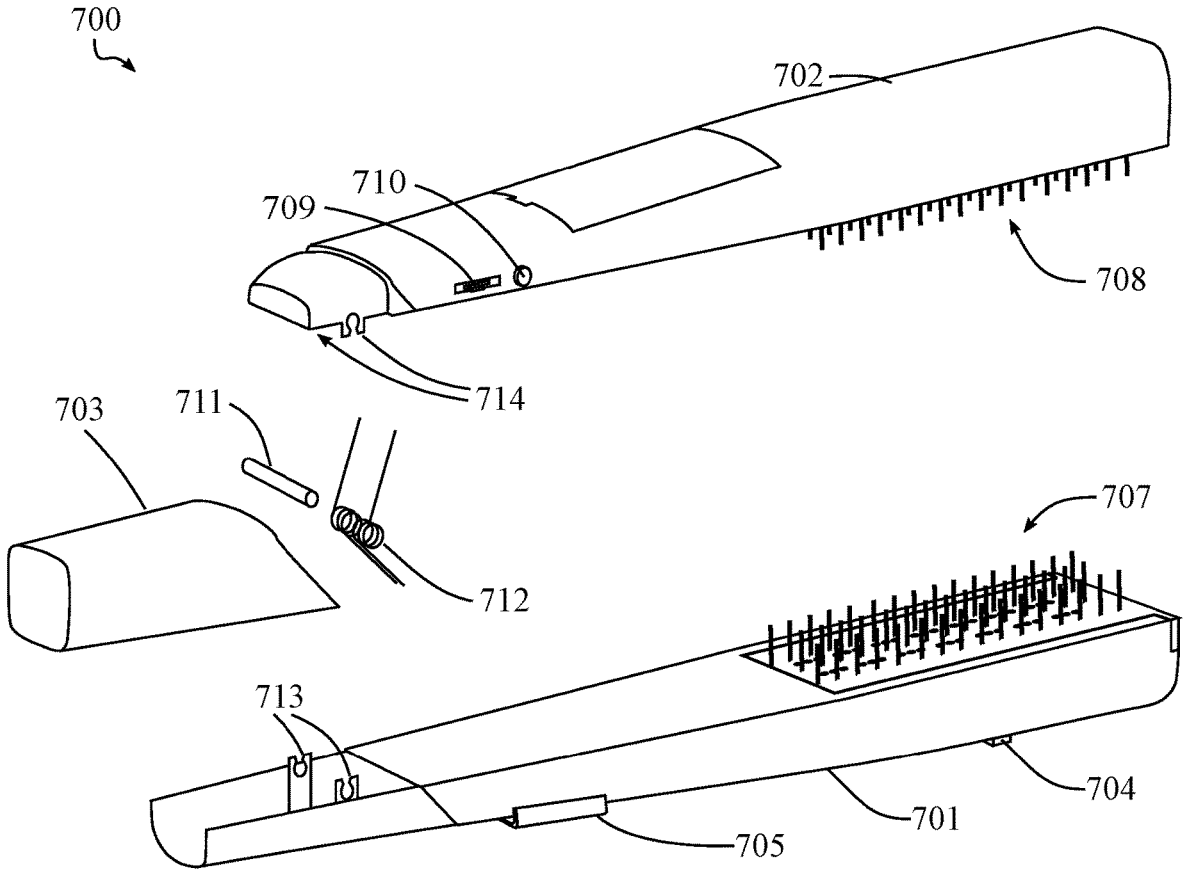
FIG. 7*d* is an exploded view of the embodiment of FIG. 7*a* with opposing arms detached from a pivot bar.

FIG. 7*c* provides a perspective view of apparatus 700 when application arm 701 and opposing arm 702 are in a closed position. Opposing manipulator 708 can have a similar construction to opposing manipulator 508 of FIG. 5*h* or passive applicator module 608 of FIG. 6*b*, wherein opposing manipulator 708 may be in a storage orientation and allow storage for a manipulator comprised by application and on-demand heating module 707, in between and adjacent to applicator seals 534 (FIG. 5*h* and FIG. 5*j*) or 634 (FIG. 6*b*) when arms 701 and 702 of apparatus 700 are in the closed position of FIG. 7*c*. FIG. 7*d* depicts apparatus 700 in an exploded view with pivot cap 703 removed and arms 701 and 702 detached. Apparatus 700 further comprises a pivot bar 711 and a pivot spring 712. Pivot bar 711 slides through pivot spring 712 and is seated between pivot sockets 713 of application arm 701 and pivot sockets 714 (only one of two is visible in FIG. 7*d*) of opposing arm 702. Pivot spring 712 provides an opening force which radially separates application and on-demand heating module 707 and opposing manipulator 708 of the clamp end of arms 701 and 702, about pivot bar 711 of the pivot end such that the user only has to apply or not apply a closing force to arms 701 and 702 to close and open the clamp end, respectively. The term clamp as it is used in this disclosure and in relation to the aforementioned configuration of moveably joined opposing arms 701 and 702 refers to a general structure and does not imply a clamping force is required or intended. In operation, when hair is captured in the clamp, it is generally loosely constrained such that the manipulators may be passed through the hair, and thus a clamping force and action, which can imply the hair is physically retrained rather that loosely constrained, is not present and is not desirable. Additionally, the manipulators present on the opposing faces of the clamp, as can be seen in FIG. 7*a*, prevent a full closure when the apparatus is in a configuration having opposing manipulator 708 in a manipulation orientation 708*a* (FIG. 7*b*) and requires opposing manipulator be inserted into opposing arm 702 in a storage orientation 708*b* for the clamp end to be fully closed as in FIG. 7*c*, as discussed in conjunction with opposing manipulator 508 of FIG. 5*j* and FIG. 5*h*, and FIG. 5*i* and FIG. 5*c* of apparatus 500.

Figure 7E:
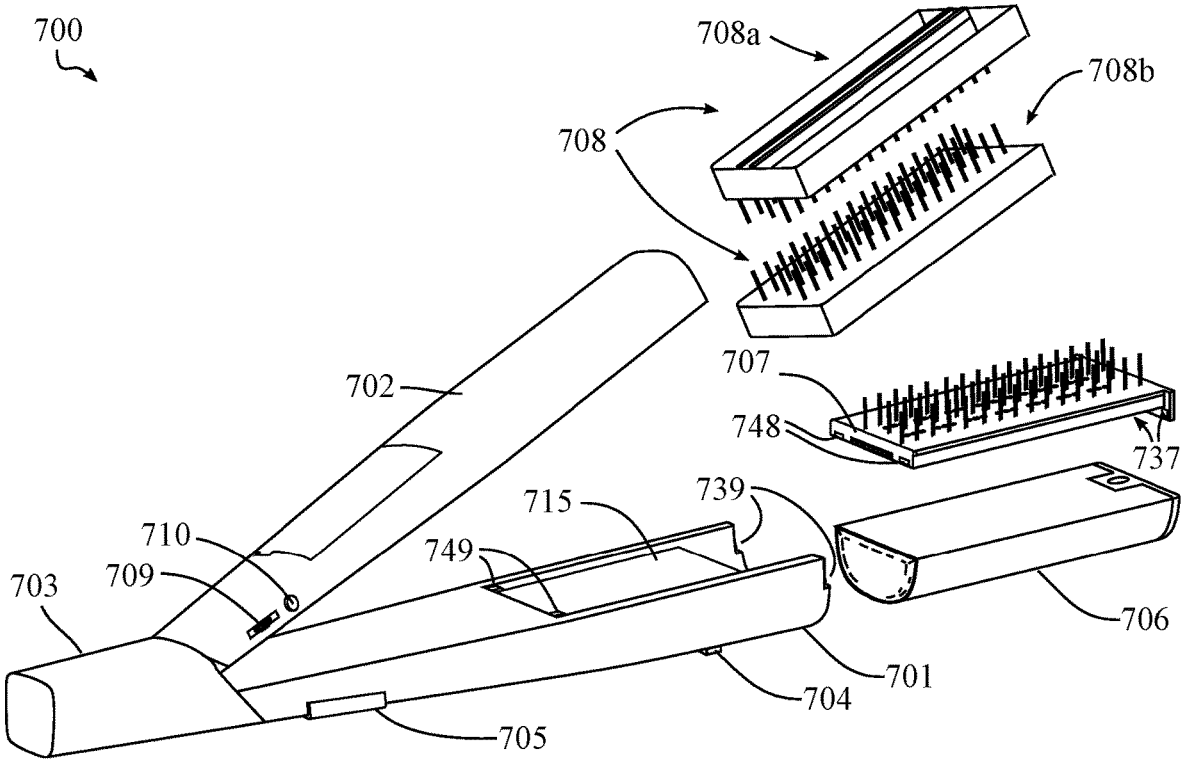
FIG. 7*e* is an exploded view of the embodiment of FIG. 7*a* with an application and on-demand heating module in a detached position, a product cartridge and shell assembly fully removed, and an opposing manipulator module depicted in a removed position and in both manipulation and storage orientations.

FIG. 7*e* illustrates apparatus 700 in a perspective view wherein application and on-demand heating module 707 and product cartridge shell assembly 706 are removed, and shows a piston 715 in an extended position. Application and on-demand heating module 707 comprises mounting sockets 748 which may receive mounting tabs 749 of application arm 701, and further comprises locking recesses 737 (only one of two is visible in FIG. 7*e*) which may lock on clip latches 739 (partially visible in FIG. 7*e*) of application arm 701, wherein mounting sockets 748, mounting tabs 749, locking recesses 737 and clip latches 739 collectively enable a secure, pivotal and removable attachment of application and on-demand heating module 707 to application arm 701.

Figure 7F:
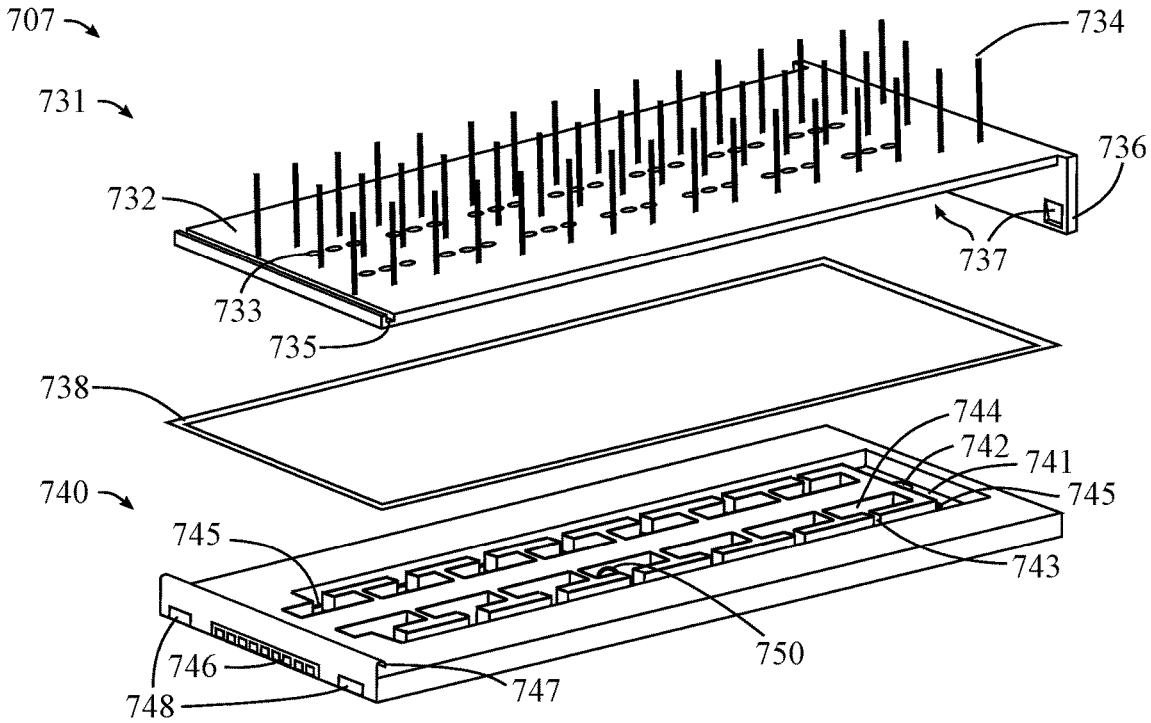
FIG. 7*f* is an exploded view of an application and on-demand heating module.

FIG. 7*f* depicts application and on-demand heating module 707 in an exploded view comprising an applicator 731, a seal 738 and a product heating and distribution plate 740. Applicator 731 comprises an exposed applicator surface 732 comprising applicator holes 733, a manipulator 734, an applicator locking edge 735 and an application and on-demand heating module locking clip 736 comprising locking recesses 737 (only one of two is visible in FIG. 7*f*). Seal 738 may be adhered to either the bottom of applicator 731 or the top, as viewed in FIG. 7*f*, of heating and distribution plate 740, but preferably not both, such that application and on-demand heating module 707 may be more easily disassembled and cleaned when desired.

Heating and distribution plate 740 comprises a u-shaped product distribution channel 741 comprising a product inlet 742, which receives product from product cartridge and shell assembly 706 through a compression seal of a cartridge access and seal feature (not visible), which is situated on the underside of plate 740 and provides access and a seal to cartridge and shell assembly 706 when collectively installed in application arm 701 (FIG. 7*e*), and a plurality of outlets 743 (only one of fourteen is referenced in FIG. 7*f*), each of which leads to a well 744 (only one of fourteen is referenced in FIG. 7*f*), each of which is situated beneath applicator holes 733 when application and on-demand heating module 707 is assembled. Outlets 743 of channel 741 become progressively larger based on an increased outlet position as registered from inlet 742 in order to present a uniform rate of product flow into each well 744, despite decreasing product fluid pressure as product flows through and out of channel 741. A heating element 745, partially visible in FIG. 7*f* and referenced in two locations by reference number 745, runs along the bottom of u-shaped channel 741 and is accordingly u-shaped, wherein each the two open ends of the u-shaped heating element terminate in a heating element terminal, comprised by a heating and distribution plate electrical interface 746. Heating and distribution plate 740 further comprises an applicator locking bar 747 which may receive applicator locking edge 735, application and on-demand heating module mounting sockets 748 which may receive mounting tabs 749 of application arm 701 as described in conjunction with FIG. 7*e*, and a thermistor 750 electrically connected to thermistor terminals comprised by heating and distribution plate electrical interface 746.

Figure 7G:
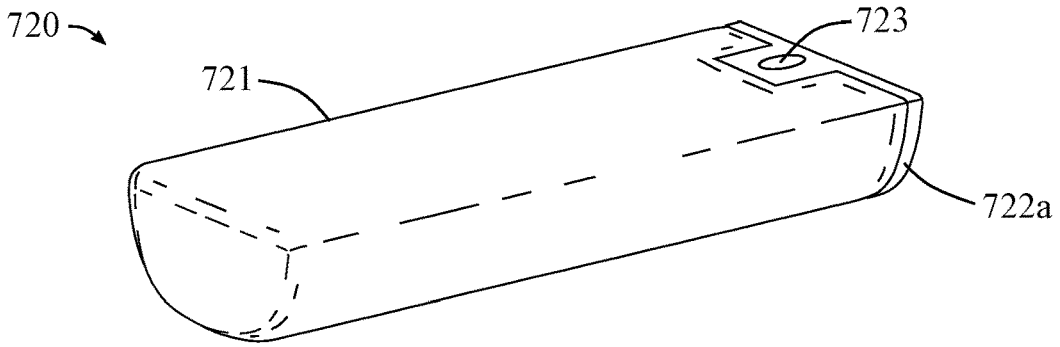
FIG. 7*g* is a perspective view of a product cartridge.
Figure 7H:
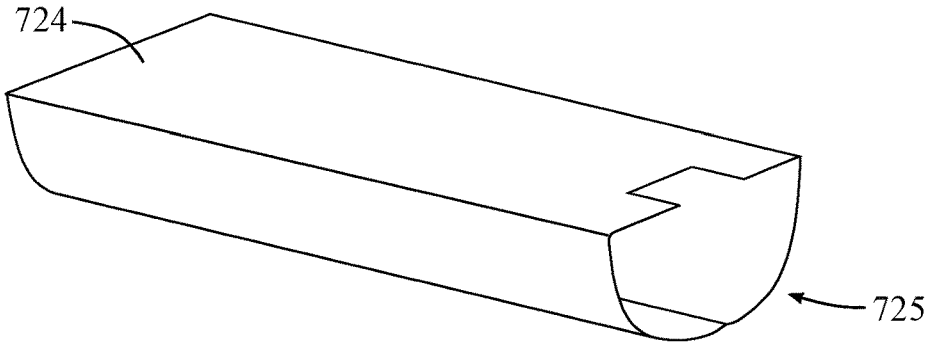
FIG. 7*h* is a perspective view of a product cartridge shell.
Figure 7I:
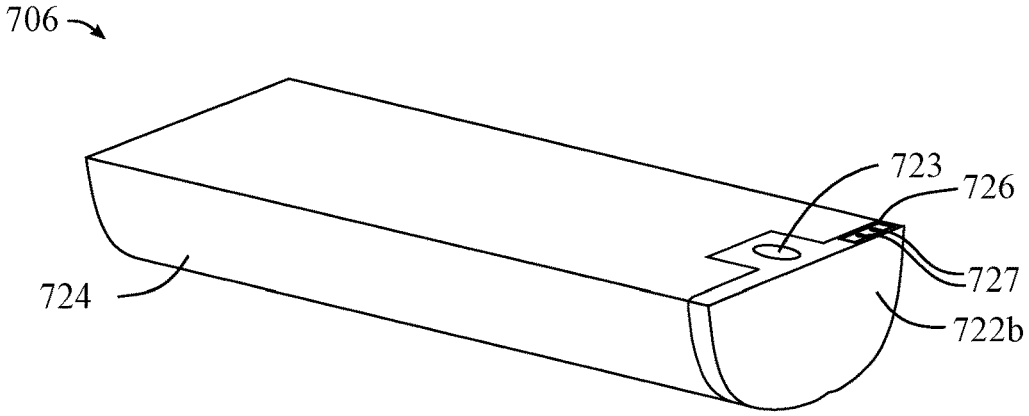
FIG. 7*i* is a perspective view of a product cartridge shell assembly depicting a rigid end comprising a readable target temperature feature.
Figure 7J:
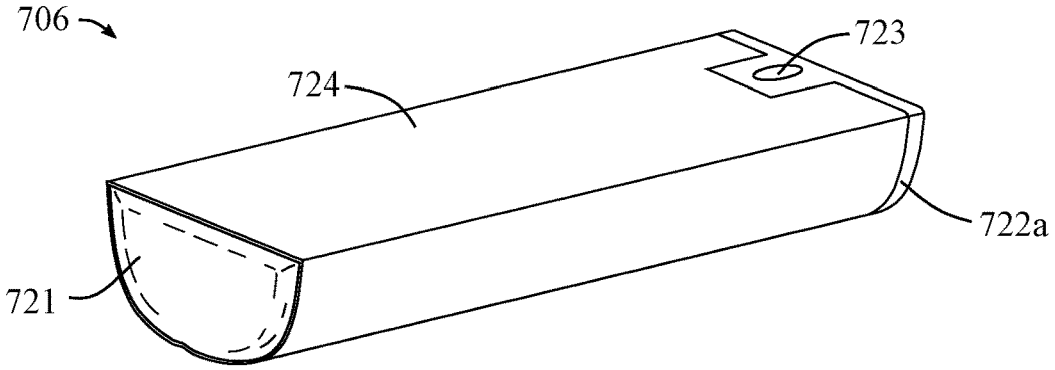
FIG. 7*j* is an alternative perspective view of a product cartridge shell assembly illustrating an exposed end of a collapsible product reservoir.

FIG. 7*g* depicts a product cartridge 720 which can be inserted into a product cartridge shell 724 of FIG. 7*h* and thereby form a product cartridge shell assembly 706 as depicted in FIG. 7*e*. Product cartridge 720 comprises a collapsible product reservoir 721, which can also be referred to as a collapsible product vessel, and a rigid dispensing end 722*a* comprising a product outlet 723. Product outlet 723 can be configured to have a seal that can be punctured by cartridge access and seal feature of application and on-demand heating module 707 to allow product contained in collapsible reservoir 721 to be dispensed and applied. Such a configuration with a puncturable seal may be suitable for a disposable prepackaged product cartridge where the seal will no longer be required once product has been accessed. In an alternative embodiment, product cartridge 720 can be configured to have a product outlet 723 comprising a reusable flexible and elastic seal which can be moved by cartridge access and seal feature of application and on-demand heating module 707 to unseal and allow product to be dispensed from or disposed into reservoir 721, and which will elastically reseal once a cartridge access and seal feature is removed therefrom. This alternative embodiment may be suitable for a reusable user fillable product cartridge 720, which may be filled using a syringe device with a cartridge access and seal feature, not shown, which may gain temporary access to to product cartridge outlet 723 via the reusable flexible and elastic seal and dispose product therein. Reservoir insertion end 725 of cartridge shell 724 of FIG. 7*h* comprises a mating shape to accept product cartridge 720 comprising rigid dispensing end 722*a* of FIG. 7*g*, or alternatively as depicted in FIG. 7*i*, a product cartridge shell assembly 706 comprising an alternative rigid dispensing end 722*b*. Rigid dispensing end 722*b* comprises a readable target temperature level feature 726, having one or more readable indicators 727. FIG. 7*i* illustrates a rigid dispensing end 722*b* comprising two such indicators 727, which can represent a binary value of 0 or 1 depending on a physical characteristic, such as a recess or no recess, respectively. A binary reading of 00, indicating two recesses, could indicate that no cartridge is present and no heating should be applied, and values 01, 10, and 11 could indicate target application temperatures of low, medium and high, respectively, each having a predetermined temperature level which may be a temperature which is both a safe temperature for hair health and a temperature that is effective for enhanced absorption of product by hair. Readable indicators 727 of readable target temperature level feature 726 may be read by miniature tactile switches, not shown, comprised on the bottom of heating and distribution plate 740 of application and on-demand heating module 707 of FIG. 7*f*, and electrically connected to electrical interface 746 comprised thereon. Miniature tactile switches may be actuated in the absence of a recessed indicator 727 or not actuated in a presence of a recessed indicator, and as such, no actuation of any switch may be used to indicate the absence of a cartridge. FIG. 7*j* depicts an alternative view of product cartridge shell assembly 706 which shows the exposed end of collapsible product reservoir 721 within shell 724 on which spring loaded piston 715 of FIG. 7*e* can exert pressure when cartridge shell assembly 706 is inserted into application arm 701.

Figure 7K:
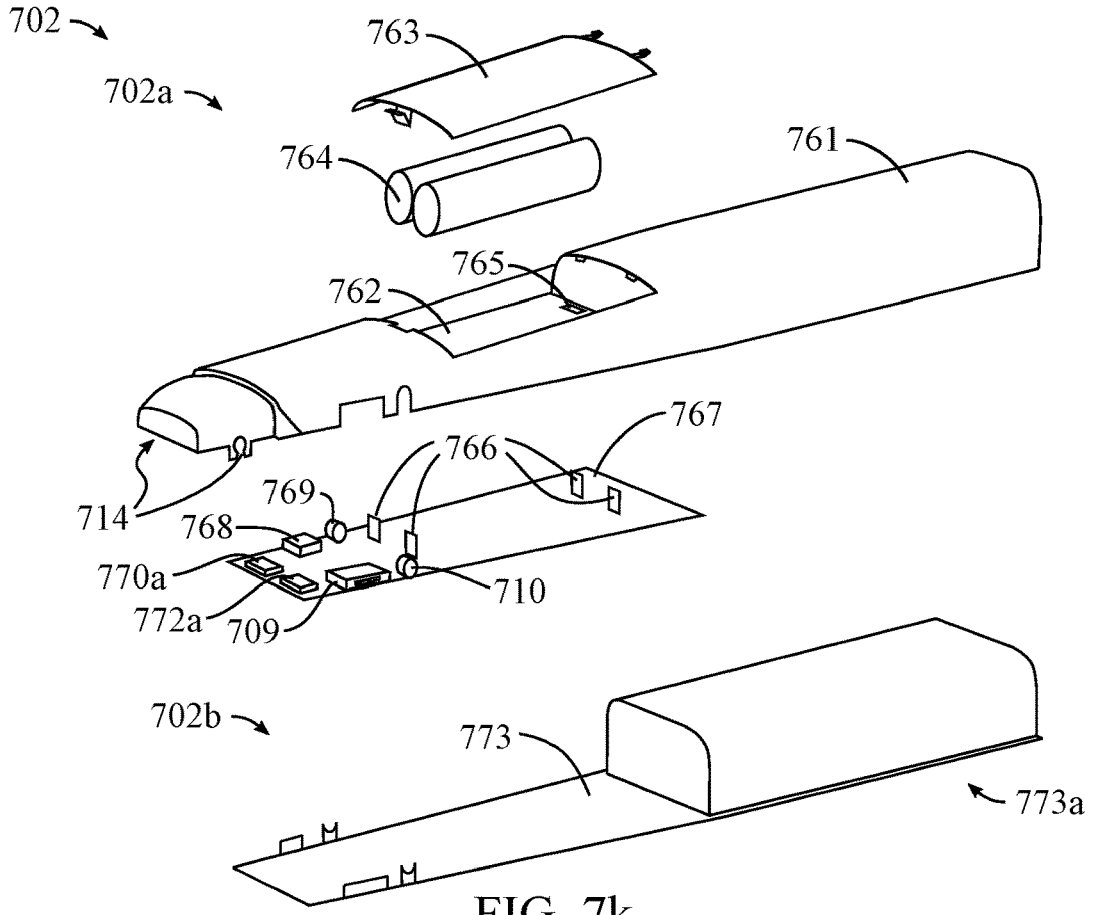
FIG. 7*k* is an exploded view of an opposing arm of the embodiment of FIG. 7*a*.

FIG. 7*k* is an exploded view of opposing arm 702 which comprises an outer assembly 702*a* and an inner component 702*b*. Outer assembly 702*a* comprises a housing 761 comprising pivot sockets 714 (only one of two is visible in FIG. 7*k*) and a battery compartment 762. Battery compartment 762 may receive rechargeable batteries 764 and a battery compartment door 763, and comprises battery terminal openings 765 (one of four is visible in FIG. 7*k*) through which battery terminals 766 of a circuit board assembly 767 may pass and connect to batteries 764. Circuit board assembly 767 additionally comprises a battery charging connector 768, a charging LED indicator 769, an application and on-demand heating module connector 770*a*, a switch 709, an LED indicator 710 and a remaining product level sensor connector 772*a*. Inner component 702*b* comprises a housing 773 comprising a receptacle 773*a* for opposing manipulator 708 of FIG. 7*b*, and can receive opposing manipulator 708 in a storage orientation 708*b* and a manipulation orientation 708*a*.

Figure 7L:
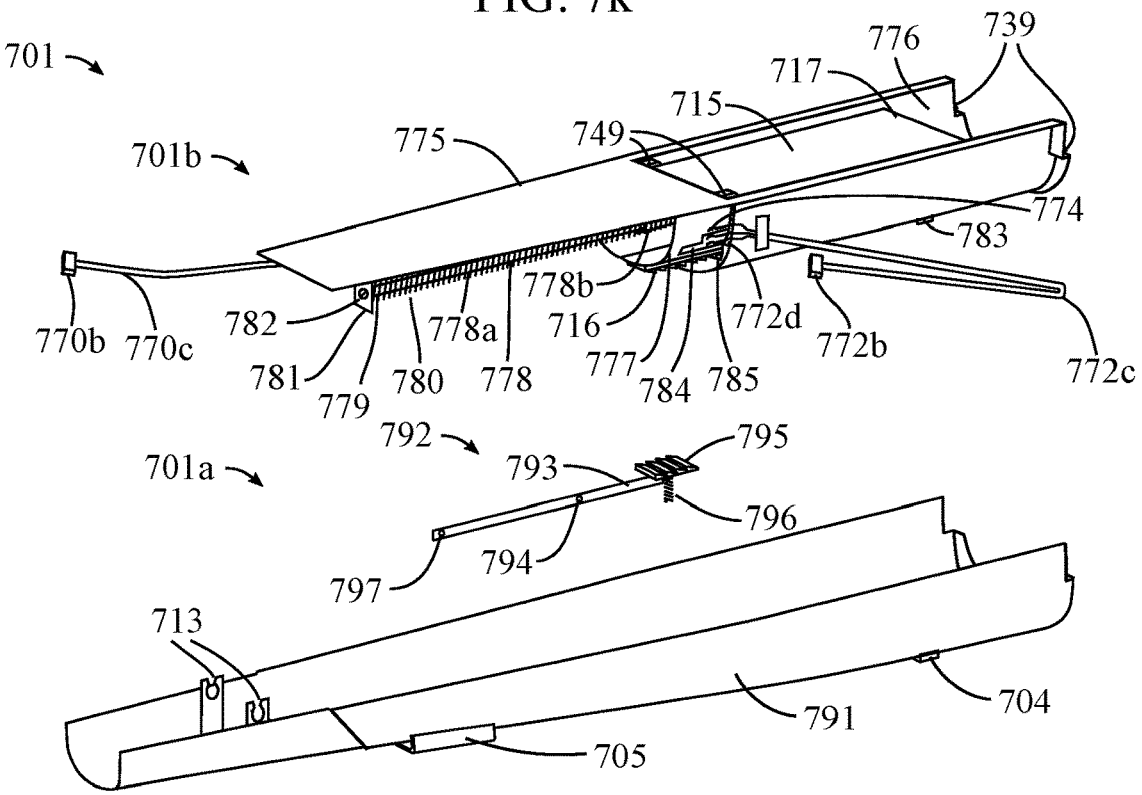
FIG. 7*l* is an exploded view of an application arm of the embodiment of FIG. 7*a*.

FIG. 7*l* is an exploded view of application arm 701 comprising an inner assembly 701*b* and an outer assembly 701*a*. Inner assembly 701*b* comprises housing 775 having a piston and cartridge chamber 776, wherein a piston 715 comprising a front portion 717 and a rear portion 777 can be moveably located and pass through a piston and cartridge chamber wall opening 785. Rear piston portion 777 is open such that a telescoping piston rod 778, having an inner rod 778*a* which may pass freely within an outer rod 778*b* of telescoping piston rod 778, and thereby make alterable the overall length of piston rod 778, may pass into piston 715 through rear portion 777, and be secured or otherwise retained by a piston rod mount, not visible, within and at the front portion 717 of piston 715. Piston rod 778 comprises a fixed end 779 mounted to a housing mount 781 and secured thereto by a fastener 782. Prior to such mounting to mount 781 and securing to piston 715, piston rod 778 is assembled within spring 780 which comprises a larger inner diameter than outer diameter of outer piston rod 778*b* such that spring 780 may move freely along piston rod 778. Piston 715 comprises a piston control arm 716 which is attached to piston 715 at the bottom of piston rear 777 and is otherwise situated having a gap space between itself and piston 715, such that piston 715 may enter into a product cartridge shell assembly 706 of FIG. 7*j* and piston control arm 716 may maintain a fixed relative position to piston 715 yet remain external to product cartridge shell assembly 706. A piston retraction arm 783 is attached to piston control arm 716 and extends therefrom at a point relative to the front portion 717 of piston 715 and through a slot, not visible, on the bottom of piston and cartridge chamber 776. Piston retractor arm 783 can be retracted such that the body of piston 715 moves through piston and cartridge chamber wall opening 785 and towards mount 781, thereby compressing spring 780 and storing elastic potential energy therein. This elastic potential energy can be selectively released and used to selectively dispense and apply hair product, as will be described later herein.

Piston 715 comprises a remaining product level conductor layer 784, partially visible in FIG. 7*l*. A wiper contact block 772*d* is attached to the rear wall of piston and cartridge chamber 776 such that as piston 715 moves through piston and cartridge chamber wall opening 785 and further into piston and cartridge chamber 776, conducting layer 784 is moved selectively out of electrical contact with wiper contacts 774 of wiper contact block 772*d*. Such selective electrical contact is thereby in relation to a location of piston 715 within piston and cartridge chamber 776, as will be later described in further detail in conjunction with FIG. 7*o*. Wiper contact block 772*d* is electrically interconnected with connector 772*b* by wiring cable 772*c*. Connector 772*b* may be connected to remaining product level sensor connector 772*a* of circuit board assembly 767 of FIG. 7*k*.

Inner assembly 701*b* of application arm 701 further comprises an application and on-demand heating module wiring cable 770*c* and connector 770*b* which may be connected to application and on-demand heating module connector 770*a* of circuit board assembly 767 of FIG. 7*k*. Wiring cable 770*c* is additionally connected to a spring loaded connector block, not visible, by a connector, not visible, which collectively provide electrical connection to heating and distribution plate electrical interface 746 of heating and distribution plate 740 (FIG. 7*e*) of application and on-demand heating module 707 of FIG. 7*f*, as will later be disclosed in more detail in conjunction with FIG. 7*p*.

Outer assembly 701*a* of application arm 701 comprises a brake assembly 792 and housing 791 comprising pivot sockets 713, piston retractor lever 704, which is attached to piston retraction arm 783, and piston release bar 705. Brake assembly 792 is operatively connected to piston release bar 705 and is releasably engaged to piston control arm 716, and allows a user to use piston release bar 705 to selectively release elastic potential energy comprised by spring 780 to control flow of product from product cartridges which may be inserted into piston and cartridge chamber 776 and engaged with piston 715, and selectively dispense and apply hair product. Brake assembly 792 comprises brake pad 795 comprising a ratcheted upper surface which allows a retraction movement directed out of piston and cartridge chamber 776 of a corresponding mating surface of piston control arm 716, and restricts a forward product dispensing motion directed into piston and cartridge chamber 776. Brake pad 795 is attached to a brake pivot arm 793. Brake pivot arm 793 is pivotally attached to a brake assembly pivot mount, not visible, of housing 791 at a pivot attachment hole 794, and further attached to piston release bar 705 at a release bar attachment hole 797. Brake pivot arm comprises brake engagement spring 796 which when installed is partially compressed between brake pivot arm 793 and housing 791 and maintains pressure and engagement between ratchet surfaces of brake pad 795 and piston control arm 716. Sufficient pressure applied to piston release bar 705, causes brake pivot arm to pivot about pivot attachment hole 794 and further compresses spring 796, thereby releasing engaged ratcheted surfaces of brake pad 795 and control arm 716, allowing piston 715 to move under force created by expending elastic potential energy of spring 780 and as permitted by depleting product volume within product reservoir 721.

Figure 7M:
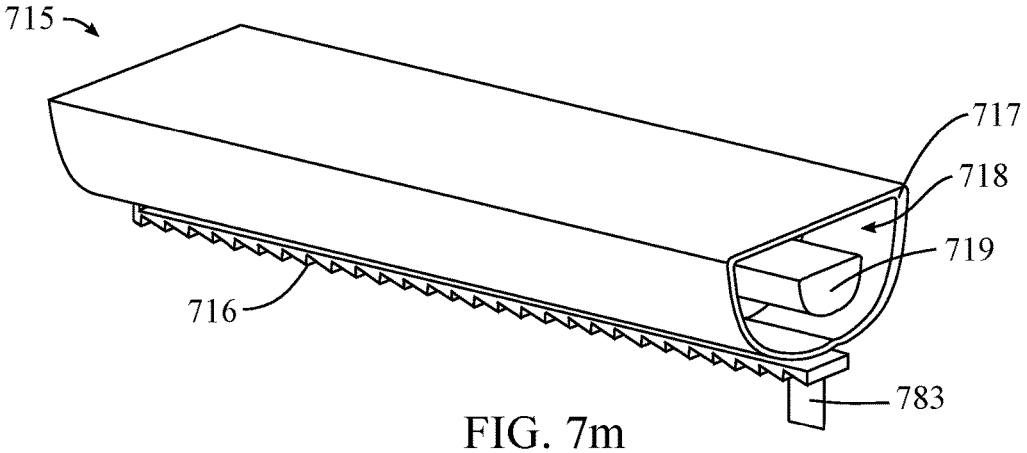
FIG. 7*m* is a perspective view of a partial piston assembly of the embodiment of FIG. 7*a* comprising a piston, a piston control arm a piston retraction arm.
Figure 7N:
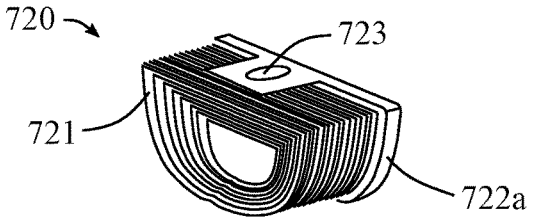
FIG. 7*n* is a perspective view of a fully collapsed and depleted collapsible product cartridge.

FIG. 7*m* depicts a piston 715 comprising a front portion 717 comprising an inwardly sloped front perimeter, a recessed collapsible reservoir collection area 718 and a central protrusion 719. Also referring to FIG. 7*j*, piston 715 is configured to cause excess collapsible reservoir wall material from a depleting collapsible product reservoir 721 to collapse and collect in recessed collapsible reservoir collection area 718 wherein it will not interfere with the forward movement of piston 715 and the corresponding dispensing and application of product. As piston 715 enters cartridge shell 724, protrusion 719 and perimeter of front portion 717 apply pressure to collapsible reservoir 721. This pressure creates fluid pressure within the product reservoir 721 which creates product flow out of product reservoir 721, through outlet 723 and into application and on-demand heating module 707 of FIG. 7e, thereby depleting product volume contained therein, and additionally creates outward fluid product pressure which forces collapsible reservoir material made excess by the depletion of product volume therein, into recessed collapsible reservoir collection area 718. Perimeter of front portion 717 can be inwardly sloped to mechanically assist the movement of excess reservoir wall material into recess area 718. As the reservoir wall material collapses and collects in recess area 718, any pressure thereon is transferred to the inner surfaces of recessed area 718 of piston 715 and therefore does not contribute to any friction or contact between collapsed reservoir material and the walls of cartridge shell 724, and thus allows piston 715 to otherwise move freely, and elastic spring energy applied to reservoir 721 is generally directed toward generating flow of product and collapsing reservoir 721, and not expended as frictional energy loss between reservoir 721 and cartridge shell 724. A resulting fully collapsed reservoir is depicted in FIG. 7n. The depth of recess area 718 can be such that collapsed reservoir material of a fully depleted product cartridge fills the recess and therefore minimal residual product remains after the product cartridge 720 is otherwise depleted.

Figure 7O:
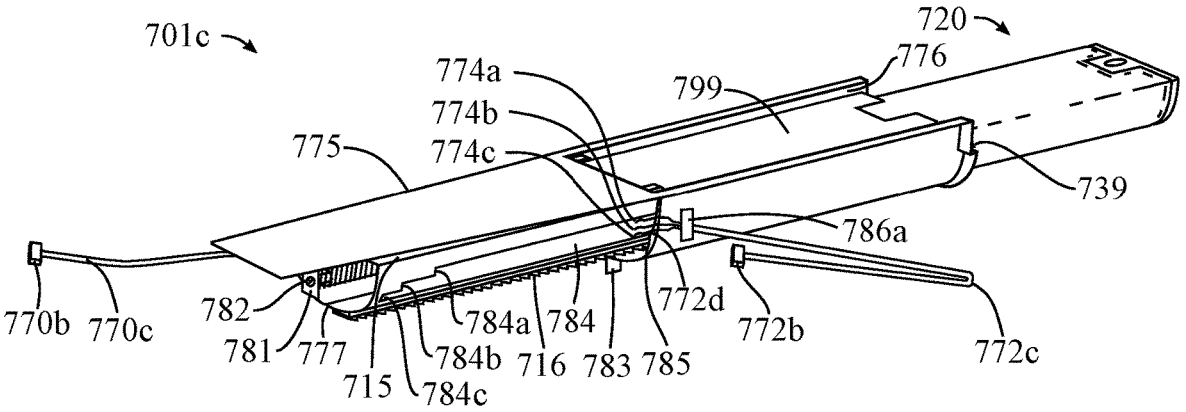
FIG. 7*o* is a perspective view of a partial inner application arm assembly comprising an alternative configuration of the assembly of FIG. 7*l*, wherein a piston and cartridge chamber comprises an integrated product cartridge shell.

FIG. 7o is a perspective view of a partial inner application arm assembly 701c comprising an alternative configuration to assembly 701b of FIG. 7l, wherein a piston and cartridge chamber 776 comprises an integrated product cartridge shell 799, such that cartridge 720 of FIG. 7g may be inserted directly into application arm 701 without the requirement to first assemble a product cartridge shell assembly 706 of FIG. 7h. This configuration may be preferable when product cartridge 720 can be stored and handled without risk of potential puncturing or rupturing. Alternatively, if such a risk is present, product cartridge can be preferably assembled in shell 724 which can offer protection against potential puncturing or rupturing, and stored, handled and loaded as a product cartridge and shell assembly 706 into an inner assembly of the embodiment of 701b shown in FIG. 7l, as previously described.

FIG. 7o illustrates components which are additionally comprised by inner application arm assembly 701b, as they may appear when piston 715 is retracted, as indicated by the location of piston rear 777 in close proximity to mount 781 and the location of retraction lever 783 in close proximity to piston and cartridge chamber wall opening 785. As briefly discussed in conjunction with FIG. 7l, piston 715 comprises a remaining product level conductor layer 784. A wiper contact block 772d is attached to the rear wall of piston and cartridge chamber 776 such that as piston 715 moves through piston and cartridge chamber wall opening 785 and further into piston and cartridge chamber 776, conducting layer 784 is moved selectively out of electrical contact with wiper contacts 774 of wiper contact block 772d. Such selective electrical contact is thereby in relation to a location of piston 715 within piston and cartridge chamber 776 and thereby can indicate a remaining product level. As illustrated in FIG. 7o, electrical connection between wiper contacts 774c and 774a is provided by conducting layer 784 until layer edge 784a passes beyond electrical connection with wiper contact 774a and further towards piston and cartridge chamber wall opening 785. Similarly, electrical contact between wiper contacts 774c and 774b is present until layer edge 784b is encountered. Layer edges 784a, 784b and 784c and wiper contacts 774a, 774b, and 774c can be positioned such that loss of electrical connection between contacts 774c and 774a, but not 774c and 774b can indicate a low amount of product is remaining in a product cartridge present in piston and cartridge chamber 776, and a loss of electrical connection between contacts 774c and 774b can indicate an empty product cartridge is present in piston and cartridge chamber 776. Wiper contact block 772d is electrically interconnected with connector 772b by wiring cable 772c. Connector 772b may be connected to product level sensor connector 772a of circuit board assembly 767 of FIG. 7k. Cable 772c may be secured to a location outside of piston and cartridge chamber 776 by tape 768a.

Figure 7P:
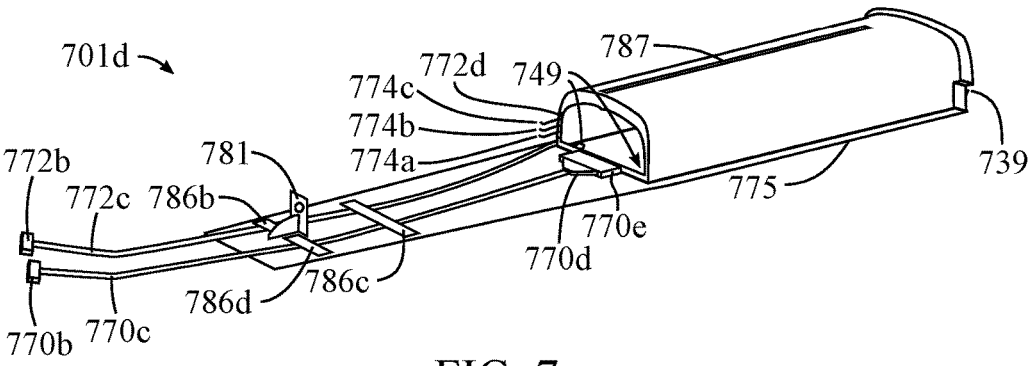
FIG. 7*p* is a perspective bottom view of a partial inner application arm assembly of the embodiment of FIG. 7*a* without a piston assembly installed.

FIG. 7p depicts inner application arm assembly 701d from a bottom view without a piston installed, thus providing a view of application and on-demand heating module wiring cable 770c and connector 770b which may be connected to application and on-demand heating module connector 770a of circuit board assembly 767 of FIG. 7k. As disclosed briefly in conjunction with FIG. 7l, wiring cable 770c is additionally connected to a spring loaded connector block 770e by a connector 770d, which collectively provide electrical connection to heating and distribution plate electrical interface 746 of heating and distribution plate 740 of application and on-demand heating module 707 (FIG. 7e). The bottom view of inner application arm assembly of FIG. 7p additionally shows retraction arm slot 787 though which retraction arm 783 (FIG. 7l) may pass and along which retraction arm 783 may travel both during a retraction of piston 715 and an application of product. FIG. 7p additionally shows tape 786b, 786c and 786c which secures and maintains a location for cables 770c and 772c.

Referring to FIG. 7e, FIG. 7f, FIG. 7k, FIG. 7l and FIG. 7o in operation, a user retracts piston 715 by moving piston retraction lever 704 towards the pivot cap 703 end of the application arm 701, if not already positioned there. The user then releases locking recesses 737 of clip 736 of application and on-demand heating module 707 from clip latches 739 and pivots the clip 736 and module 707 upward, pivoting on mounting tabs 749. The user then inserts into piston and cartridge chamber 776, a product cartridge shell assembly 706, or simply a product cartridge 720 in the case of the configuration of FIG. 7o, wherein piston and cartridge chamber 776 comprises an integrated shell 799. The user then secures clip 736 back to a latched position which causes cartridge access and seal feature of application and on-demand heating module 707 to gain access to product through product outlet 723 and seal of product cartridge 720, and seal thereto, and permit product flow into inlet 742 of product distribution and heating plate 740. The user then positions switch 709 to an "on" position, thereby causing power from batteries 764 to be supplied to circuitry residing on circuit board assembly 767. If no cartridge is detected from a "00" reading from micro switches attempting to read a non-present cartridge or target application temperature feature 726, or a cartridge is present but determined to be empty by measuring the electrical connectivity status of wiper contacts of wiper contact block 772d, LED indicator 710 may indicate a warning that no available product is present by, for example, emitting a flashing red color of light. Should a cartridge be present and wiper contacts of wiper contact block 772 indicate product is available therein, LED indicator 710 may indicate a favorable apparatus status, such as by first emitting one, two or three flashes of green light to indicate a target temperature of low, medium or high, respectively, as read from readable target temperature indicator 726 or as indicated by a position of switch 709, followed by a non-flashing color of green. A user may previously have moved or may now move opposing manipulator 708 to a manipulation orientation 708*a*.

To apply product, a user may press piston release bar 705 thereby disengaging brake pad 795 ratchet surface from piston control arm 716 ratchet surface, allowing piston 715 to move towards piston and cartridge chamber 776 and transfer force from spring 780 to collapsible reservoir 721 generating pressure therein and causing product to flow out of reservoir 721 and into inlet 742 and distribution channel 741 of product distribution and heating plate 740. As product distribution and heating plate 740 and thermistor 750 comprised therein encounter unheated product, a resistance level indicating a temperature below a target level as indicated by a position of switch 709 or a readable target temperature indicated by indicator 726 is registered by circuitry of circuit board assembly 767 which then supplies power from batteries 764 to heating element 745 until such time that the target temperature is achieved. Power is applied to heating element 745 in proportion to the negative delta between the measured temperature indicated by thermistor 750 and the target temperature, wherein negative delta means the amount by which the measured temperature is lower than the target temperature. Any time a zero or positive delta is encountered, no power is applied. As such, when product is not flowing and product within the application and on-demand warming module 707 simply needs to be maintained near or at the target temperature, power will be minimally applied in response to a gradual cooling and an observed small negative delta between measured and target temperatures. Alternatively, when product begins to flow and the negative delta increases, power will be applied in an increasing amount proportional to the amount of the negative delta, thereby controlling the temperature to a minimized delta and thus regulating the temperature to the target temperature.

Retraction lever 704 will traverse a slot (not visible) in application arm 701 as product in product cartridge 720 is being depleted and piston 715 and piston control arm 716, to which it is attached via retraction arm 783, advance position within piston and cartridge chamber 776. The slot can be appropriately marked to provide a user with a convenient indication of remaining product. Apparatus 700 may additionally comprise a remaining product level sensor which can provide one or more additional indications such as indicating remaining product is at a low amount or product is fully depleted. Such indications could be made by flashing LED indicator 710 with a green color to indicate a low amount remains or flashing red to indicate product is fully depleted.

Figure 8A:
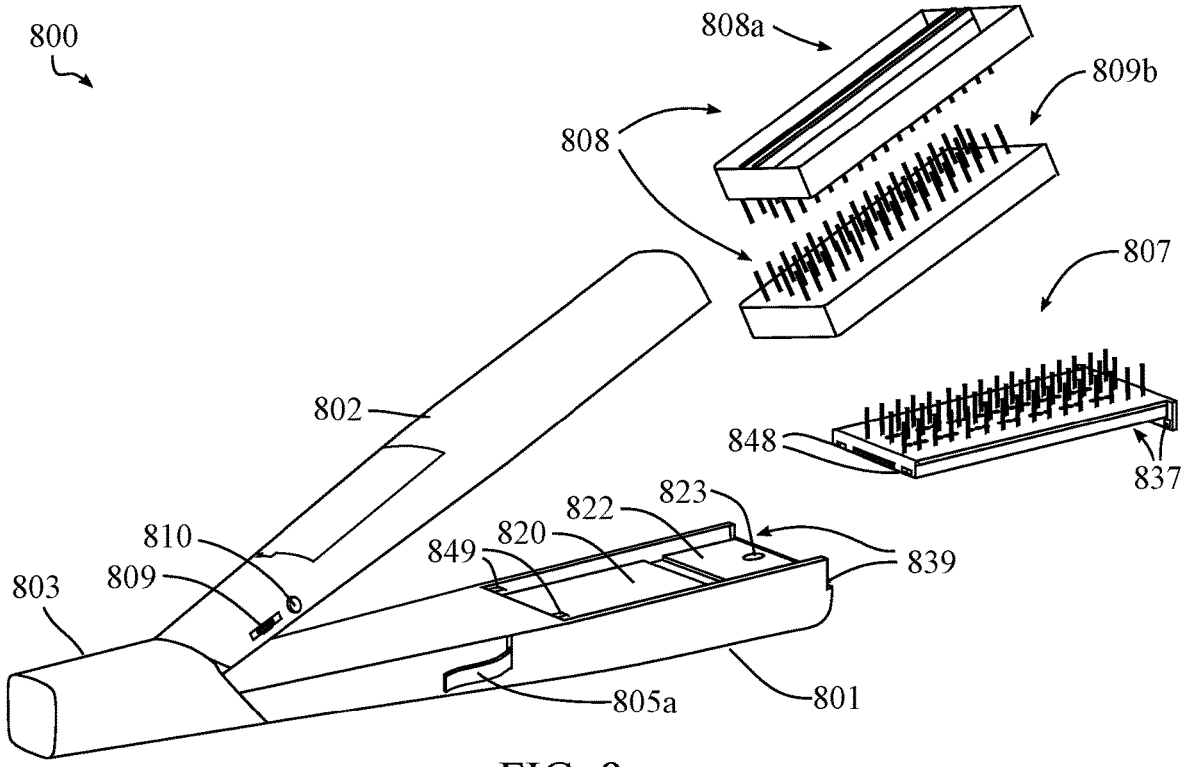
FIG. 8*a* is a perspective view of an illustrative embodiment with opposing arms comprising an application and on-demand heating module, an opposing manipulator module and pump follower driven product cartridge dispensing system, and having modules removed.

FIG. 8*a* is a perspective view of an illustrative embodiment of an apparatus 800, comprising opposing arms similar to apparatus 500 and apparatus 700, namely an application arm 801 and an opposing arm 802. Apparatus 800 further comprises an opposing manipulator 808, which may be inserted in opposing arm 802 in a manipulating orientation 808*a* or a storage orientation 808*b*, and an application and on-demand heating module 807 similar to apparatus 700. Dissimilar to apparatus 700, apparatus 800 comprises a pump follower mechanism, comprising a pump head 822 and a product cartridge 820, for generating product flow. Pump head 822 and product cartridge 820 can be of a conventional pump follower design, wherein the action of pressing cartridge 820 against a spring action and into pump head 822, displaces product therein and causes it to flow out of an outlet 823 of pump head 820. When the spring action returns cartridge 820 from its encroached position within pump head 822, a check valve prevents any backflow, product is pulled into pump head 822 from cartridge 820 to replace the volume occupied by the previously encroaching cartridge 820, and a one-way inwardly traveling floor within product cartridge 822 travels inward in an equivalent volumetric response to the volume of product pulled from cartridge 820 and into pump head 822. In order to apply the action required to pump product, a pump actuation lever is configured on each side of application arm 801. A right pump actuation arm 805*a* is visible in FIG. 8*a*.

Aside from the pump follower mechanism, apparatus 800 is largely similar to apparatus 700 and most of the details common to both embodiments will not be repeated. However it will be noted that further similar to apparatus 700, and as shown if FIG. 8*a*, apparatus 800 further comprises a pivot cap 803, a switch 809, an LED indicator 810, application and on-demand heating module 807 mounting sockets 848 which receive mounting tabs 849 of application arm 801, and application and on-demand heating module 807 locking recesses 837 (only one of two is visible in FIG. 8*a*) which lock on clip latches 839 (partially visible in FIG. 8*a*) of application arm 801, wherein mounting sockets 848, mounting tabs 849, locking recesses 837 and clip latches 839 collectively enable a secure, pivotal and removable attachment of application and on-demand heating module 807 to application arm 801.

Figure 8B:
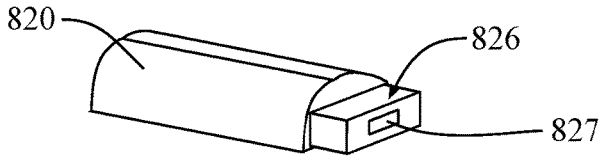
FIG. 8*b* is a perspective view of a product cartridge for use in the embodiment of 8*a*.
Figure 8C:
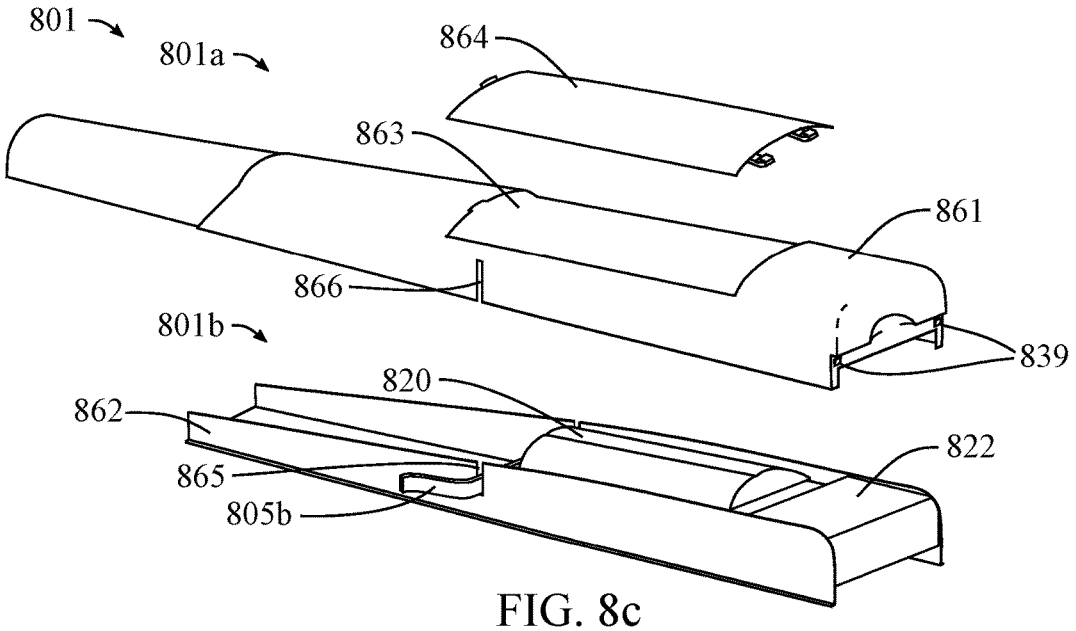
FIG. 8*c* is an exploded bottom view of a partial application arm assembly of the embodiment of FIG. 8*a*.

FIG. 8*b* depicts product cartridge 820, which can also be referred to as a product vessel, comprising a neck 826 and a cartridge product outlet 827, wherein, neck 828 in inserted into pump head 822 and product flows from cartridge 820 to pump head 822 as described in the aforementioned disclosure through outlet 827. FIG. 8*c* depicts a bottom and exploded perspective view of application arm 801 comprising an outer assembly 801*a* and an inner assembly 801*b*. Outer assembly 801*a* comprises a housing 861 comprising a product cartridge access 863 which may receive a product cartridge 820 and an access door 864. Housing 861 further comprises a pump actuation lever slot on each side, of which slot 866 is visible in FIG. 8*a*, and clip latches 839. Inner assembly 801*b* comprises housing 862 comprising an inner pump actuator slot on each side, of which 865 is visible, and further comprises pump actuation levers 805*a* (not visible) and 805*b*, pump head 822 and product cartridge 820. In use, product is pumped by depressing either lever 805*a* or 805*b*, depending on which is most convenient and which hand is grasping apparatus 800.

In the foregoing detailed disclosure, a plurality of illustrative embodiments have been described. Each embodiment generally comprises an applicator, a manipulator and a can receive a provision of product and is configured to enable a user to concurrently apply product and style or otherwise manipulate their hair. Some embodiments comprise product delivery systems which use pressure to generate product flow, some embodiments comprise product delivery systems which use gravitational forces to deliver product flow, and one illustrative embodiment uses both pressure and gravitational forces to generate product flow. Illustrative embodiments of pressure based product delivery systems are disclosed herein which comprise mechanical pumps, both air and airless, electrical pumps and spring driven pistons. Some illustrative embodiments disclosed herein comprise an internal heating system and some illustrative embodiments support a heating of product in a microwave oven or in a heated liquid bath, or other forms of external heating of product. Illustrative embodiments disclosed may receive a provision or volume of product in a variety of ways comprising in a housing, in a reservoir and in a cartridge, the latter of which may be a user filled cartridge, or may be a prepackaged cartridge, and all can be generally referred to as comprising or receiving a volume of product in a product vessel. Disclosure of additional material which may be further explanatory and illustrative and relate to one or more of the foregoing detailed disclosed embodiments is now provided.

Holes or openings, and patterns thereof, in an applicator surface can be varied to vary the rate of flow of product therethrough. In embodiments where product flows primarily due to gravitational forces, such as described in apparatus 100, 101 and 200, which comprise gravity driven systems, applicators will generally require larger applicator openings than in embodiments where product flows primarily due to applied pressure, such as pressure applied from a pump or a piston, as described in apparatus 300, 500, 700 and 800, which comprise pressure driven systems. The viscosity of product varies considerably from light oils to heavy oils to creams and softened butters. Heating product produces additional variations in product viscosities. Fluid flow in a gravity system is primarily dependent on product viscosity and a compromise in a suitable opening size and pattern must be found to accommodate a range of product viscosities and resulting range of flow rates. Furthermore, gravity systems may be less effective for use with high viscosity products than with low viscosity products, and not suitable for use with softened butters and thick creams. In a pressure system, fluid flow is primarily dependent not on the viscosity of the product, but rather the specific gravity of the product, which is relatively consistent across types of product. In a pressure system, an opening geometry can be chosen which minimizes leaking of the product by way of a mechanism of surface tension across the opening, yet provides optimal flow under pressure for a wide range of product viscosities.

Apparatus 300 provides a pump mechanism where a user can expedite delivery of product, but since it requires product to be in contact with the applicator openings for such expediting, and it is dependent on gravitational forces to deliver product to applicator openings where air pressure can then assist in the flow of product through the applicator openings, it is more effectively used with lower viscosity oils which can move to the applicator openings more freely under gravitational forces. When high viscosity products such as creams and softened butters are used, the pressure systems of apparatus 500, 700 and 800 are more effective than systems that rely, at least partially, on gravitational forces, as the systems of apparatus 500, 700 and 800 provide positive delivery of product under pressure to and through applicator openings regardless of orientation of the apparatus and gravitational forces.

Electric pump systems can be envisioned that work directly on the product, namely, the product moves through the electric pump, as opposed to the system of apparatus 500 where the electric pump moves air to a reservoir to provide pressure to generate product flow. In systems where an electric pump acts directly on the product, an inline flow sensor can be configured to provide for a measurement of and regulation of flow of product. Such systems could include a user controllable variable flow rate control. In such systems where an electric pump acts directly on the product, the electric pump will reside between the product vessel and the applicator, and an application and on-demand heating module is preferably used to heat product, such as that used in embodiments 700 and 800. In contrast, a less desirable alternative of heated product being pumped from a reservoir allows for the product to cool as it is pumped through the system, and anytime the system is paused between user applications of product, the product is allowed to cool further.

In gravity systems such as those of apparatus 100, 101 and 200 the flow rate may be controlled by varying the aperture of the applicator openings. For example, a shutter comprising an appropriate pattern of openings could be positioned behind and against the applicator pattern of openings and be operatively coupled to an actuator button that operates against a spring to slide the shutter and release the shutter to slide back, thereby varying apertures of the applicator openings through a range from completely closed to completely opened to control the product flow rate from a rate of zero flow to a rate of maximum flow, respectively.

A varied selection of manipulator structures can be provided, such as teeth, bristles and/or other structures to manipulate hair for detangling, curl enhancing, combing, brushing, shaping, styling and other forms of manipulation during a hair care process. An apparatus may be marketed with a plurality of manipulator options including user exchangeable, user configurable manipulators. In this manner and depending on the particular characteristics of the hair and preferences of an individual using the apparatus, a given manipulator or plurality of manipulators can be selected for optimizing the hair care process. In embodiments such as those of apparatus 500, 700 and 800 comprising an opposing manipulator, a combination of two different manipulator types can be used when deemed advantageous by an individual using the apparatus. Additionally, applicators and user selectable options thereof, can comprise manipulators which can comprise openings for product flow. For example, teeth manipulators can be hollow providing a piping action from the applicator surface to surfaces of the teeth, such as the sides or tips of the teeth or both. An apparatus comprising an applicator and opposing manipulator such as 500, 700 and 800 may be configured to use applicator manipulators and opposing manipulators which are interchangeable. When so configured, a reduction in unique parts to be manufactured, inventoried and distributed may be achieved by the manufacturer and product distributors, and the user of an apparatus may have fewer unique parts to purchase and manage while still achieving a higher degree of configurability.

At least one manipulator on an apparatus should serve to detangle and comb or brush hair in order to efficiently distribute and apply product as well as style and manipulate hair. As such a plurality of teeth, bristles, fins or other such protruding structures capable of passing through strands of hair are needed on at least one manipulator on the apparatus. In combination with this manipulator comprising a plurality of structures, a manipulator useful for sectioning hair, wherein sectioning hair generally means parting hair and defining a section of hair for current attention of the hair care process, may be useful. In this case, an additional manipulator comprising a single or lesser number of protruding structures may be useful to section hair.

A user of an apparatus comprising an applicator and opposing manipulator such as 500, 700 and 800 may find their particular hair characteristics are best managed by using a broadly spaced, large tooth manipulator geometry comprised by an applicator, and a tightly spaced, finer bristle on an opposing manipulator module. The user may find that the large tooth applicator manipulator can be favored when detangling and applying an initial application of product, and a tighter closure of the clamp and a combined emphasis of both manipulators is expeditious to distribution of product and finer manipulation of a section of hair once detangled and an initial application of product is disposed thereon. Furthermore, such a tooth geometry of an applicator manipulator may provide less resistance to an intimate contact between some hair types and the applicator surface, whereas a finer bristle geometry on an opposing manipulator will be effective is directing hair to the surface of the applicator when the clamp is drawn closer together.

Alternative embodiments for apparatus similar to apparatus 700 and apparatus 800 can be considered, wherein lower cost alternative embodiments are manufactured and marketed which comprise fewer electrical components or do not comprise any electrical components. For example, application and on-demand heating modules can be alternatively configured as non-heating applicators and product cartridges can be manufactured to support alternative heating in a microwave oven or liquid bath, and optionally comprise a thermochromatic device or material to indicate a temperature that is both safe for hair health and enhanced absorption by hair is present. As an additional alternative example, an external cartridge heater which can receive a plurality of cartridges and run off wall power can be provided. Furthermore, in an alternative embodiment for apparatus similar to apparatus 700, regardless of the heating method being a heater comprised by the apparatus or an external heating source, lower cost prepackaged product can be achieved by configuring the cartridge shell to additionally comprise the rigid dispensing end, such that the prepackaged product is simply a collapsible product reservoir, which can also be called a collapsible product vessel or be referred to as the product cartridge, and is filled with a volume of product. In this configuration, the cartridge shell comprising the rigid dispensing end can be reused to lower the total cost of use of the apparatus and consumables including prepackaged product cartidges, and when an external heating source is used, the reusable cartridge shell comprising the rigid dispensing end can further optionally comprise a thermochromatic device or material to indicate a temperature that is both safe for hair health and enhanced absorption by hair is present.

The United States Consumer Product Safety Commission notes that a thermostat setting of 120 degrees Fahrenheit (49 degrees Celsius) may be necessary for residential water heaters to reduce or eliminate the risk of most tap water scald injuries. As such, a temperature level of 120 degrees Fahrenheit (49 degrees Celsius) can be used as a target temperature level for a "high" setting or upper temperature level of a range of temperature, as it is a safe temperature for hair health and is additionally safe for incidental short term skin contact with product heated to that temperature, while providing for indirect heating of hair and enhanced product absorption thereby.

A practical size for the capacity of a product vessel is between 2 ounces to 3.4 ounces (100 milliliters), where the latter is the limit imposed by the Transportation Security Administration for individual items of liquids, creams and gels for acceptance through security checkpoints.

The various illustrative embodiments disclosed herein should not be construed as an exhaustive list. Rather the various embodiments presented serve to illustrate only some of the various ways to practice the invention and many additional combinations of features and configurations are possible within the scope of the invention disclosed herein.

What is claimed is:

1. A hair care apparatus comprising:

a first arm and a second arm moveably joined together, wherein:

the first arm comprises a first arm face;

the second arm comprises a second arm face;

the first arm face and the second arm face are directed towards each other and form a partially closable and openable clamp which can receive a section of hair therebetween;

a product vessel or a chamber for receiving a received product vessel, wherein:

the product vessel or the received product vessel can receive or comprise a volume of product; and the first arm face comprises an applicator surface comprising one or more through-openings in fluid communication with the product vessel or the received product vessel, wherein a flow of product can flow from the product vessel or the received product vessel and flow through the one or more through-openings to an area of exposed surface of the applicator surface;

a heater configured to heat product prior to flowing through the one or more through-openings, wherein no heater is configured to heat an arm face;

a temperature sensing device configured to sense a temperature associated with a product temperature, wherein:

the heater is controlled at least in part based on the temperature sensed by the temperature sensing device, and heats the product to a given temperature level or a given range of temperature and maintains the product at the given temperature level or the given range of temperature at least in part based on the temperature sensed by the temperature sensing device; and the flow of product that can flow through the one or more through-openings can comprise product heated by the heater to a given temperature level or a given range of temperature; and a plurality of outwardly extending manipulator members comprised by the first arm face and having proximal ends located proximate to the one or more through-openings through which product can flow, or comprised by the second arm face and having distal ends, whereupon a closing action of the partially closable and openable clamp the distal ends are directed towards the one or more through-openings through which product can flow, wherein:

when the first arm and the second arm are drawn towards each other, distal ends of the first plurality of outwardly extending manipulator members are directed towards an opposing arm face and can pass through a section of hair received between the first arm face and the second arm face; and a full closing between the first arm face and the second arm face of the partially closable and openable clamp is not permitted.

2. The apparatus of claim 1, wherein:

the product vessel or the received product vessel is a prepackaged product vessel and the volume of product is a prefilled volume of product disposed in the prepackaged product vessel;

the prepackaged product vessel comprises a readable temperature feature indicating a temperature level or a range of temperature; and the apparatus is configured to read the readable temperature feature and to control the heater to heat and maintain the prefilled volume of product to the given temperature level or the given range of temperature indicated by the readable temperature feature.

3. The apparatus of claim 1, wherein the heater and the temperature sensing device are located in the flow of product downstream from the product vessel or the received product vessel, and the heater heats and maintains the heated product temperature of the flow of product after the flow has issued from the product vessel or the received product vessel.

4. The apparatus of claim 1, further comprising a pump configured to at least in part generate the flow of product through the one or more through-openings.

5. The apparatus of claim 4 further comprising a pump control, wherein the pump is an electrically driven pump, and the pump control actuates the flow of product through the one or more through-openings, and is a variable control that can initiate/terminate a variable rate of flow, or is an on/off switch that can initiate/terminate the flow.

6. The apparatus of claim 4, further comprising a product flow rate sensor and a product flow rate control settable to a given rate of flow, wherein the pump is an electrically driven pump, and the flow rate of product flowing through the one or more through-openings can be a regulated flow of product measured by the flow rate sensor and regulated to the given rate of flow.

7. The apparatus of claim 1, wherein the plurality of outwardly extending manipulator members is a first plurality of outwardly extending manipulator members, the apparatus further comprising a second plurality of outwardly extending manipulator members, wherein the first plurality of outwardly extending manipulator members have proximal ends disposed on the first arm face, and the second plurality of outwardly extending manipulator members have proximal ends disposed on the second arm face, wherein:

the second plurality of outwardly extending manipulator members have distal ends directed towards the first arm face and can pass through a section of hair received between the first arm face and the second arm face; and when the first arm and the second arm are drawn towards each other, a full closing of the partially closable and openable clamp is not permitted.

8. The apparatus of claim 1, further comprising a piston, wherein the product vessel or the received product vessel is a collapsible product vessel and the piston is configured to apply an external positive pressure to the collapsible product vessel to cause it to collapse at least in part and to generate the flow of product through the one or more through-openings, wherein the external positive pressure is applied independent of any relative movement between the first arm and the second arm.

9. The apparatus of claim 8, further comprising a product dispensing control and a storable and selectively appliable energy coupled to the piston and usable to selectively generate the flow of product through the one or more through-openings, wherein the storable and selectively appliable energy is selectively applied by storing energy prior to a subsequent one or more actuations of the product dispensing control.

10. The apparatus of claim 1, further comprising a cartridge access feature, wherein:

the product vessel or the received product vessel is a product cartridge fillable or prefilled with the volume of product, and is receivable by the chamber when inserted into the apparatus, and comprises a cartridge seal to seal the volume of product therein; and the cartridge access feature penetrates the cartridge seal and engages the cartridge with a sealing action in conjunction with an insertion of the product cartridge into the apparatus, and enables the flow of product that can flow through the one or more through-openings.

11. The apparatus of claim 10, further comprising a heating and distribution plate comprising:

the cartridge access feature;

a product distribution channel in fluid communication with the cartridge access feature and the one or more through-openings and providing fluid communication between the product cartridge and the one or more through openings; and a heating element of the heater disposed in the product distribution channel and configured to heat product, wherein the flow of product that flows through the one or more through-openings is:

enabled by the cartridge access feature;

flows through the product distribution channel; and is heated by the heating element disposed in the product distribution channel.

12. The apparatus of claim 11, further comprising heating element control circuity configured to control the heating element, wherein:

the temperature sensing device is disposed in the product distribution channel and configured to sense the temperature of product therein; and the heating element is controlled at least in part based on a temperature sensed by the temperature sensing device, and heats the product to a given temperature level or a given range of temperature and maintains the product at the given temperature level or the given range of temperature at least in part based on the temperature sensed by the temperature sensing device; and the heating element control circuitry applies power to the heating element in response to and in proportion to a negative delta between the temperature sensed by the temperature sensing device and the given temperature level or the given range of temperature, wherein the negative delta is the amount by which the sensed temperature is lower than the target temperature.

13. The apparatus of claim 1, wherein:

the product vessel or the chamber for receiving a received product vessel is a first product vessel or a first chamber for receiving a first received product vessel, and the apparatus comprises a second product vessel or a second chamber for receiving a second received product vessel;

the applicator surface is a first applicator surface;

the one or more through-openings comprised by the first applicator surface is a first one or more through-openings in fluid communication with the first product vessel or the first received product vessel; and the second arm face comprises a second applicator surface comprising a second one or more through-openings in fluid communication with the second product vessel or the second received product vessel.

14. The apparatus of claim 1, wherein the first arm face comprising the applicator surface comprises the plurality of outwardly extending manipulator members, wherein the first arm face is removably attached to the first arm.

15. A hair care apparatus comprising:

a first arm and a second arm moveably joined together, wherein:

the first arm comprises a first arm face;

the second arm comprises a second arm face; and the first arm face and the second arm face are directed towards each other and form a partially closable and openable clamp which can receive a section of hair therebetween;

a releasably engaged product cartridge configured to comprise a volume of product;

an applicator surface and a plurality of outwardly extending manipulator members comprised by the first arm face; wherein;

the first arm face is removably attached to the first arm;

the applicator surface comprises one or more through-openings in fluid communication with the product cartridge, wherein a flow of product can flow from the product cartridge and flow through the one or more through-openings to an area of exposed surface of the applicator surface; and proximal ends of the plurality of outwardly extending manipulator members comprised by the first arm face are located proximate to the one or more through-openings through which product can flow, wherein:

when the first arm and the second arm are drawn towards each other, distal ends of the plurality of outwardly extending manipulator members are directed towards the second arm face and can pass through a section of hair received between the first arm face and the second arm face; and a full closing between the first arm face and the second arm face of the partially closable and openable clamp is not permitted; and a heater configured to heat product prior to flowing through the one or more through-openings, wherein no heater is configured to heat an arm face.

16. The apparatus of claim 15, further comprising a cartridge access feature, wherein:

the product cartridge comprises a cartridge seal to seal a volume of product therein; and the cartridge access feature penetrates the cartridge seal and engages the cartridge with a sealing action in conjunction with an insertion of the product cartridge into the apparatus, and enables the flow of product that can flow through the one or more through-openings.

17. The apparatus of claim 16, further comprising a distribution plate comprising:

the cartridge access feature; and a product distribution channel in fluid communication with the cartridge access feature and the one or more through-openings, wherein the flow of product that flows through the one or more through-openings is enabled by the cartridge access feature and flows through the product distribution channel.

18. The apparatus of claim 17, wherein:

the distribution plate is a heating and distribution plate;

the apparatus further comprises heating element control circuitry; and the heating and distribution plate further comprises:

a heating element comprised by the heater, wherein the heating element is disposed in the product distribution channel, wherein the heating element control circuity is configured to control the heating element to heat product as it is within and/or flows through the distribution channel; and a temperature sensing device disposed in the product distribution channel configured to sense the temperature of product temperature therein, wherein:

the heating element is controlled by the heating element control circuitry at least in part based on a temperature sensed by the temperature sensing device, and heats the heated product to a given temperature level or a given range of temperature and maintains the heated product at the given temperature level or the given range of temperature at least in part based on the temperature sensed by the temperature sensing device; and the heating element control circuitry applies power to the heating element in response to and in proportion to a negative delta between the temperature sensed by the temperature sensing device and the given temperature level or the given range of temperature, wherein the negative delta is the amount by which the sensed temperature is lower than the target temperature.

19. The apparatus of claim 15, wherein the product cartridge comprises a thermochromatic material that visually indicates if the temperature of product therein is at and/or exceeds a given temperature level or a given range of temperature level.

20. The apparatus of claim 15, further comprising a pump configured to at least in part generate the flow of product through the one or more through-openings.

21. The apparatus of claim 15, wherein the plurality of outwardly extending manipulator members is a first plurality of outwardly extending manipulator members, the apparatus further comprising a second plurality of outwardly extending manipulator members, wherein the second plurality of outwardly extending manipulator members have proximal ends disposed on the second arm face, wherein:

the second plurality of outwardly extending manipulator members have distal ends directed towards the first arm face and can pass through a section of hair received between the first arm face and the second arm face; and when the first arm and the second arm are drawn towards each other, a full closing of the partially closable and openable clamp is not permitted.

* * * * *